US009403639B2

(12) United States Patent
Bleile et al.

(10) Patent No.: US 9,403,639 B2
(45) Date of Patent: Aug. 2, 2016

(54) MODULAR TRANSPORTABLE TANK SYSTEM AND METHOD OF ASSEMBLY

(71) Applicant: STRAD ENERGY SERVICES LTD., Calgary (CA)

(72) Inventors: Leonard Bleile, Calgary (CA); Gregory J. Solomon, Clayton, NC (US)

(73) Assignee: STRAD ENERGY SERVICES LTD., Calgary (CA)

( * ) Notice: Subject to any disclaimer, the term of this patent is extended or adjusted under 35 U.S.C. 154(b) by 66 days.

(21) Appl. No.: 13/886,082

(22) Filed: May 2, 2013

(65) Prior Publication Data

US 2014/0144908 A1 May 29, 2014

Related U.S. Application Data

(60) Provisional application No. 61/642,780, filed on May 4, 2012.

(51) Int. Cl.
*B65D 88/08* (2006.01)
*B65D 88/52* (2006.01)
(Continued)

(52) U.S. Cl.
CPC ..... *B65D 88/528* (2013.01); *B65D 88/08* (2013.01); *B65D 90/024* (2013.01); *B65D 90/205* (2013.01); *E04H 7/06* (2013.01); *Y10T 29/49826* (2015.01); *Y10T 29/49895* (2015.01)

(58) Field of Classification Search
CPC .... B65D 90/024; B65D 88/10; B65D 88/528; B65D 88/526; B65D 88/522; B65D 88/08; B65D 88/06; B65D 90/205; Y10T 29/49826; Y10T 29/49895; E04H 7/06
USPC ..... 220/4.31, 4.17, 4.16, 565
See application file for complete search history.

(56) References Cited

U.S. PATENT DOCUMENTS 2,347,309 A * 4/1944 Zoldok ..... 220/4.16
3,225,362 A * 12/1965 Barrera ..... 52/169.1
(Continued)

FOREIGN PATENT DOCUMENTS

| | | |
|---|---|---|
| DE | 1902718 | 8/1970 |
| WO | 8908178 | 9/1989 |
| WO | 2008154697 | 12/2008 |

OTHER PUBLICATIONS

New Zealand Examination Report, New Zealand Patent Office, dated May 10, 2013.
(Continued)

*Primary Examiner* — Stephen Castellano
(74) *Attorney, Agent, or Firm* — Parlee McLaws LLP (CGY); Sean W Goodwin

(57) ABSTRACT

Arcuate, lightweight composite panels, which are transportable on flatbed trucks, are interconnected onsite for forming a temporary fluid tank. A shaped groove along one end of the panel and a shaped tongue along an opposing end of the panel permit a panel to be lifted vertically above and offset another of the panels and then slid axially together, with the tongue of one panel engaged in the groove of the adjacent panel. If the ground on which the tank is to be assembled is uneven, the panels can be misaligned vertically along the interconnected tongue and groove to accommodate the unevenness of the ground. Where the tank does not engage the ground about the entire bottom edge, a liner can be placed inside the tank and connected to the tank using a hook and loop fastening system.

29 Claims, 29 Drawing Sheets

(51) Int. Cl.

| | |
|---|---|
| ***B65D 90/02*** | (2006.01) |
| ***B65D 90/20*** | (2006.01) |
| *E04H 7/06* | (2006.01) |

(56) References Cited

U.S. PATENT DOCUMENTS

| | | | | | |
|---|---|---|---|---|---|
| 3,291,437 | A | * | 12/1966 | Bowden et al. | 249/48 |
| 3,440,780 | A | * | 4/1969 | West et al. | 52/169.7 |
| 3,584,757 | A | * | 6/1971 | Blaisdell | 220/4.28 |
| 3,648,303 | A | * | 3/1972 | Stewart et al. | 52/5 |
| 3,793,651 | A | * | 2/1974 | Pitti et al. | 52/169.7 |
| 3,819,079 | A | * | 6/1974 | Levens | 220/4.13 |
| 3,951,294 | A | * | 4/1976 | Wilson | 220/4.31 |
| 3,959,830 | A | * | 6/1976 | van den Broek | 52/287.1 |
| 4,125,394 | A | * | 11/1978 | Wilson | 71/9 |
| 4,216,634 | A | * | 8/1980 | Binder | 52/309.9 |
| 4,223,498 | A | * | 9/1980 | Ventrice | 52/249 |
| 4,240,562 | A | * | 12/1980 | Holschlag | 220/565 |
| 4,324,081 | A | * | 4/1982 | Chicha | 52/432 |
| 4,457,441 | A | * | 7/1984 | McCloughan | 220/4.12 |
| 4,492,065 | A | * | 1/1985 | Clarke et al. | 52/592.4 |
| 4,860,914 | A | * | 8/1989 | Derni et al. | 220/4.28 |
| 4,974,551 | A | * | 12/1990 | Nelson | 122/19.2 |
| 5,161,264 | A | * | 11/1992 | Dugas | 4/506 |
| 5,261,555 | A | * | 11/1993 | Rogers et al. | 220/592.22 |
| 5,289,933 | A | * | 3/1994 | Streich et al. | 220/1.5 |
| 5,536,111 | A | * | 7/1996 | Doernemann | 405/16 |
| 6,564,960 | B1 | * | 5/2003 | Grindstaff et al. | 220/4.31 |
| 7,481,899 | B2 | * | 1/2009 | Boyd | 156/191 |
| 7,654,401 | B2 | * | 2/2010 | Obergoenner | 217/65 |
| 8,136,177 | B2 | * | 3/2012 | Kan | 4/506 |
| 8,365,937 | B2 | * | 2/2013 | Lovelace et al. | 220/4.17 |
| 2012/0234829 | A1 | * | 9/2012 | Lovelace et al. | 220/4.01 |
| 2013/0098929 | A1 | * | 4/2013 | Lovelace et al. | 220/682 |

OTHER PUBLICATIONS

New Zealand Examination Report, New Zealand Patent Office, dated Sep. 3, 2013.

* cited by examiner

MODULAR TRANSPORTABLE TANK SYSTEM AND METHOD OF ASSEMBLY

CROSS REFERENCE TO RELATED APPLICATIONS

This application claims the benefits under 35 U.S.C 119(e) of U.S. Provisional Application Ser. No. 61/642,780, filed May 4, 2012, which is incorporated herein by reference in its entirety.

FIELD

Embodiments described herein relate to tanks which are modular and transportable for assembly on-site, such as for temporarily containing large volumes of fluids utilized during oil or gas well servicing operations, and, more particularly, to tank panels, connectors and methods of assembly.

BACKGROUND

Oil and gas servicing operations require fluid for a variety of reasons, most commonly during drilling and completions operations. The fluid may be used in drilling operations for lubricating the borehole, cleaning away cuttings, and maintaining control of the well by overcoming the reservoir pressure. In completion operations, fluid is generally used for stimulating the formation, such as by acidizing or fracturing, cleaning the well bore, and maintaining well control. In most cases the amount of fluid required is large and the fluid must be prepared and stored onsite during the operation. Onsite tanks may also be used to store fluids such as run-off water, diesel fuel, glycol, oils, waste products and the like. Upon completion of the drilling and completion operations however large volume tanks used to contain such fluids onsite may no longer be required.

In completion operations, the fluid used is a fracturing fluid which is typically a mixture of at least water and a proppant, such as sand. Tanks used to store the fracturing fluid, commonly referred to as frac tanks, are fluidly connected to a pump, such as by a hose or pipe, so as flow the fracturing fluid down the wellbore at sufficiently high pressures to fracture the formation. The proppant in the fracturing fluid enters the newly created void space and acts to prop the spaces open, permitting reservoir fluid to flow more freely to the wellbore.

One type of conventional frac tank is a rectangular shaped pre-assembled tank unit that is towed behind a truck as a tractor-trailer assembly. This type of conventional tank typically has a capacity of about 500 barrels. Thus, multiple tanks are needed onsite in situations where the fluid volume requirement is greater than 500 barrels, such as in completion operations for stimulating multiple zones in deep horizontal wells.

Another type of conventional frac tank consists of an assembly of multiple panels which are transported onsite for assembly of the tank thereat. The panels for the conventional multi-panel tanks are typically made of steel and are very heavy. Due to weight restrictions and the like, several truck-trailer units may be required to deliver the panels to the site. Further, the steel panels require an onerous assembly process as a result of many fasteners required to hold the tank panels together.

In the case of the conventional multi-panel tanks, where the surface or ground on which the tank is to be assembled is angled or is uneven and undulating, alignment and assembly of the panels may be problematic.

Clearly, there is a need for high volume, transportable fluid storage tanks that are light weight and easy to assemble, such as for temporary use onsite in the oil and gas industry.

SUMMARY

In embodiments disclosed herein, transportable, arcuate panels having complementary connectors can be assembled in the field without fasteners, such as pins or bolts. A female connector having a shaped groove extends along one end of the panel and a male connector having a shaped tongue extends along the other end of the panel. For assembly with like panels, the tongue on one panel is slid axially into the groove of the adjacent panel. The connectors lock together circumferentially while permitting vertical misalignment between the adjacent panels, such as on sloped or uneven ground. A limited rotation between complementary female and male connectors, allows the panels to engage even when the panels are not perfectly aligned during assembly and further permit embodiments of the tank having multiple radii.

In a broad aspect, a transportable tank system comprises: three or more arcuate panels, each panel having first and second opposing and parallel ends and having a bottom edge and a top edge extending therebetween; an elongate female connector having a shaped groove extending along the first end; and an elongate male connector having a shaped tongue formed along the second end. When the three or more arcuate panels are arranged in a perimeter on a surface with the first and second ends oriented substantially vertically therefrom, the shaped tongue of the male connector of each arcuate panels slidably engages within the shaped groove the panels adjacent thereto for circumferential locking therebetween.

In another broad aspect, a transportable, arcuate panel for use with like panels for constructing a tank for containing fluid therein, comprises: first and second opposing ends and a bottom edge and a top edge extending therebetween. At least an inner skin extends between the first and second ends. A core is structurally bonded to the inner skin. An elongate female connector having a shaped groove extends along the first end; and an elongate male connector having a shaped tongue extends along the second end. The shaped groove on the female connector and the shaped tongue of the male connector are adapted to engage between adjacent like panels so as to permit circumferential locking and axial engagement and disengagement therebetween.

In a broad method aspect, a method for construction of a tank uses three or more arcuate panels having first and second opposing ends and a bottom edge and a top edge extending therebetween. An elongate female connector having a shaped groove extends along the first end; and an elongate male connector having a shaped tongue extends along the second end. A first of the three or more panels is arranged on a surface, the opposing ends being substantially vertical thereto. A second of the three or more panels is lifted above and offset the first panel. A bottom of the shaped groove on the first end of the second panel is aligning above a top of the shaped tongue on the second end of the first panel. The second panel is lowered for axially engaging the shaped tongue within the shaped groove; and the steps are repeated for the remaining panels of the three or more panels for forming the tank perimeter.

In embodiments, the panels are FRP panels which are lightweight, strong and durable. In other embodiments, the panels could be made of steel or other suitable materials. The male and female connectors are typically extruded aluminum and are replaceably secured to ends of the panels so that the connectors can be replaced during use if worn or damaged.

Where the bottom of the tank perimeter does not engage the ground on which the perimeter is assembled, a liner can be placed within the perimeter and secured to the assembled panels using hook and loop fastener or clamps. The liner can then be replaced with each use or as necessary.

BRIEF DESCRIPTION OF THE DRAWINGS

FIG. 13A illustrates the interconnected tongue and groove having a uniform gap therebetween when the connectors are not in tension FIG. 13B illustrates the interconnected tongue and groove having a non-uniform gap therebetween when the connectors are in tension, the tongue bottoming out in the groove as the connectors are placed in tension such as when the tank is filled with fluid; and FIG. 13C illustrates limited rotation about an arc radius, such as when the panels are assembled for forming a substantially cylindrical tank;

FIG. 15A is a side view of the stack of panels showing cribbing positioned beneath the stack for supporting the stack; and FIG. 15B is a cross-sectional view along lines A-A illustrating neoprene positioned between the panels for protecting the stacked panels;

FIG. 18 illustrates aligning the groove of the female connector of a second panel over the temporary male guide and tongue of the first panel;

FIG. 19 illustrates the male guide entering the groove of the female connector;

FIG. 20 illustrates engagement of the male guide in the groove of the female connector;

FIGS. 21 to 26 illustrate axial engagement of the tongue of the male connector in the groove of the female connector as the second panel is lowered and slid downward relative to the first panel;

FIG. 28A is a front view of the female guide;

FIG. 28B is a side view of the female guide; and

FIG. 28C is a plan view of the female guide installed over the groove of a female connector, shown in dotted lines;

DESCRIPTION

Figure 1:
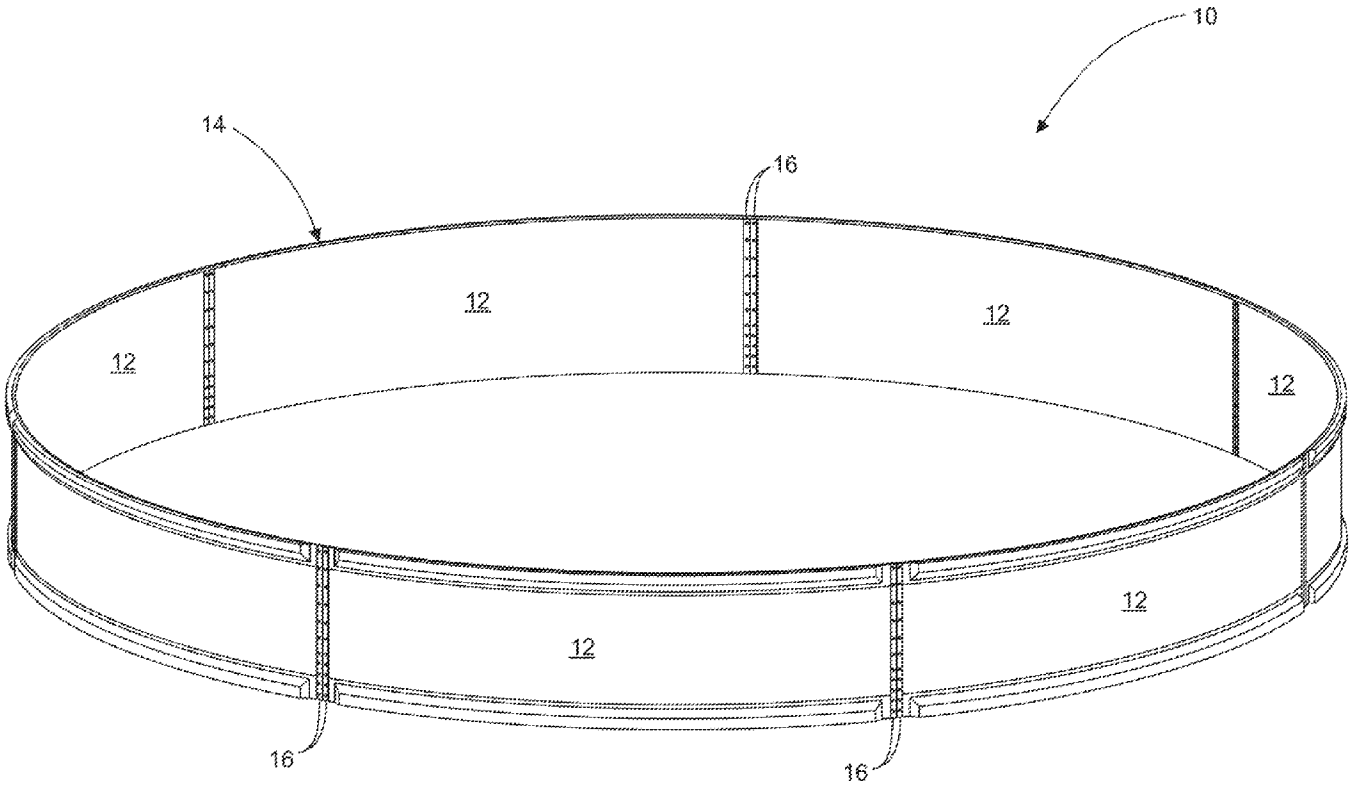
FIG. 1 is a perspective view of a modular tank according to an embodiment described herein.
Figure 2:
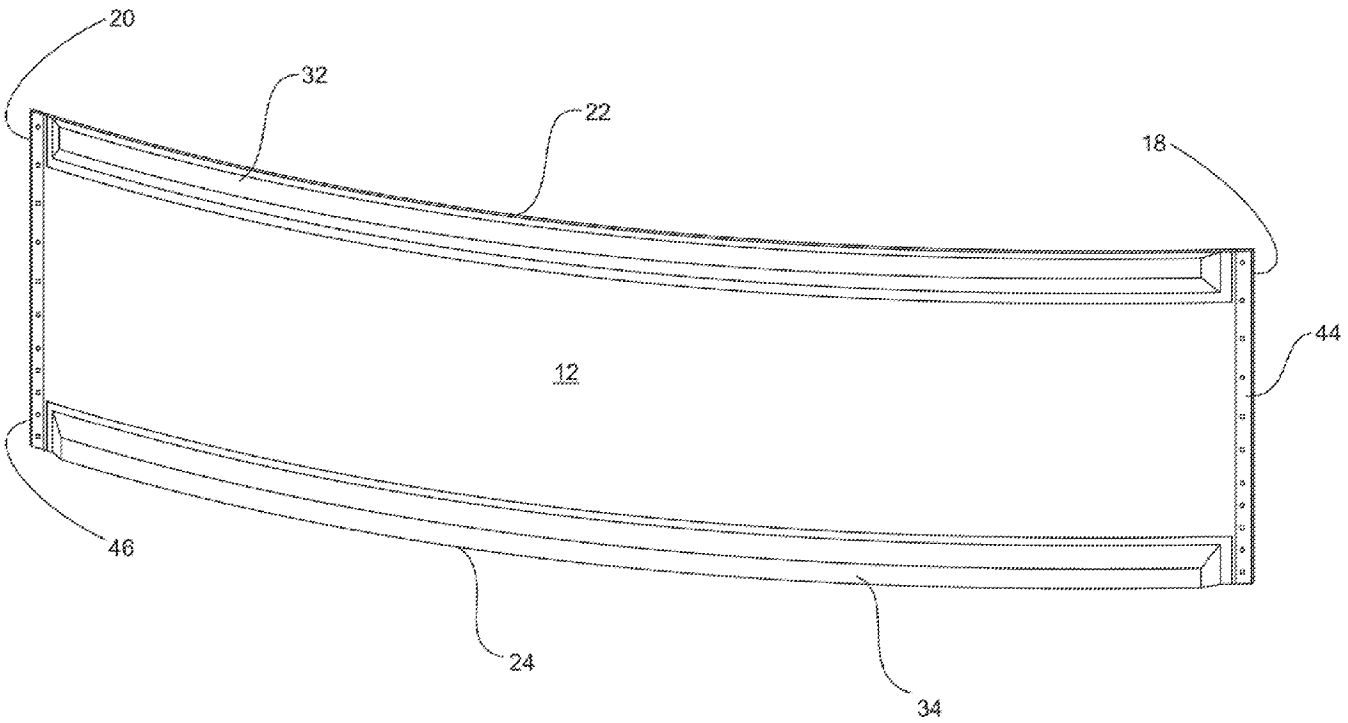
FIG. 2 is a perspective view of a lightweight composite panel used for assembly of the tank according to FIG. 1.
Figure 3:
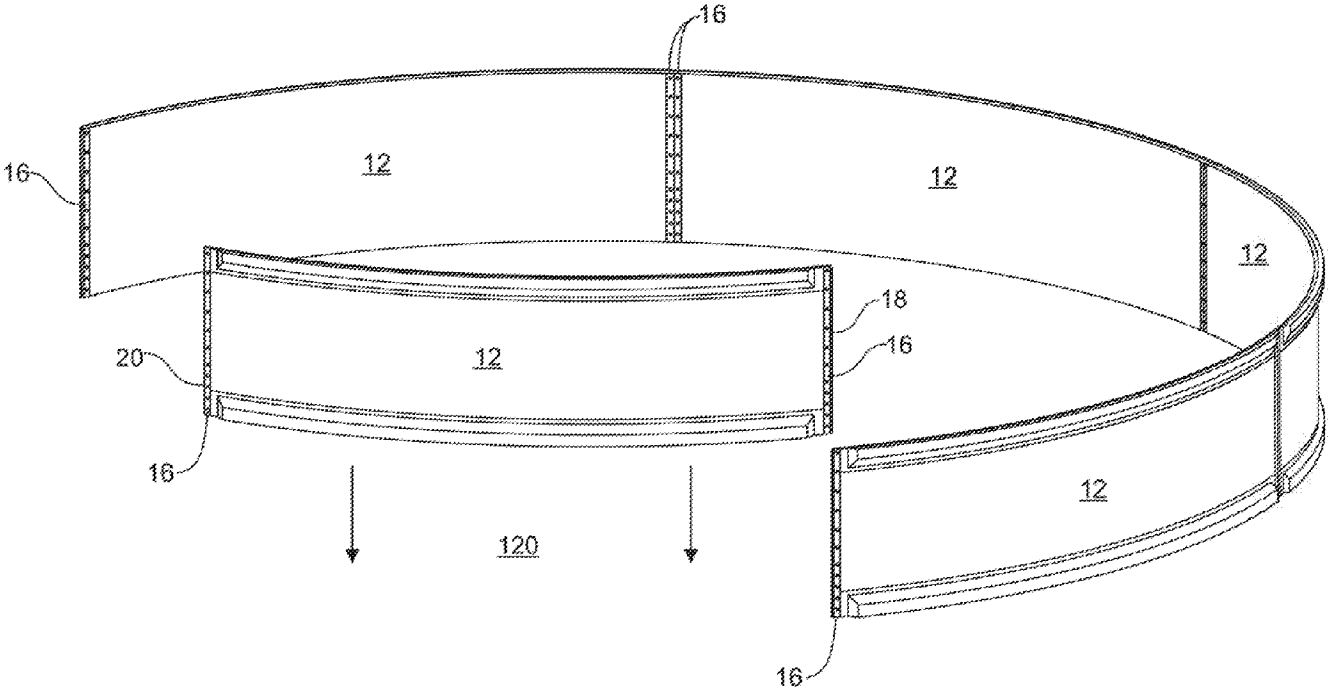
FIG. 3 is a perspective view according to FIG. 1, a panel being inserted into a space between already-assembled panels for forming a tank perimeter.

Embodiments of a transportable tank, system and methods of assembly, are disclosed herein. As shown in FIGS. 1-3, the transportable tank 10, often referred to as a sectional knock-down tank, comprises three or more arcuate panels 12 which are interconnected at mating, parallel ends for forming a perimeter 14 of the tank 10 for containment of liquids F therein. The arcuate panels 12 are manufactured as fiber-reinforced plastic or polymer (FRP) panels and are relatively lightweight. When unassembled the panels 12 are compactly stackable on a surface S, such as on a truck bed for transport onsite or on another surface such as the ground for storage. Complementary, mating end connectors 16 are used for connecting the three or more panels 12 together for forming the tank 10. The connectors 16 act to lock the three or more arcuate panels 12 circumferentially relative to one another, but permit a higher up and down tolerance for assembly relative to one another than in the prior art, such as when assembled on uneven ground. The connectors 16 allow the panels 12 to misalign vertically relative to adjacent panels 12.

Embodiments described herein do not require bolts or pins field for assembly and provide a simplified assembly process when compared to the prior art. Composite FRP panels 12 for forming the tank 10 are lighter than conventional steel tank panels, making the embodiments easier and safer to maneuver and assemble.

Transportable Tank System

Panels

With reference to FIG. 2, each panel 12 of the three or more arcuate panels 12 for forming the tank's perimeter 14 has a first end 18, a second end 20 and a top edge 22 and a bottom edge 24 extending therebetween. The first end 18 and the second end 20 are parallel to one another. While the particular arrangement of the top and bottom edges 22,24 is not critical, each panel 12 is generally rectangular if it could be rolled out flat.

Figure 4:
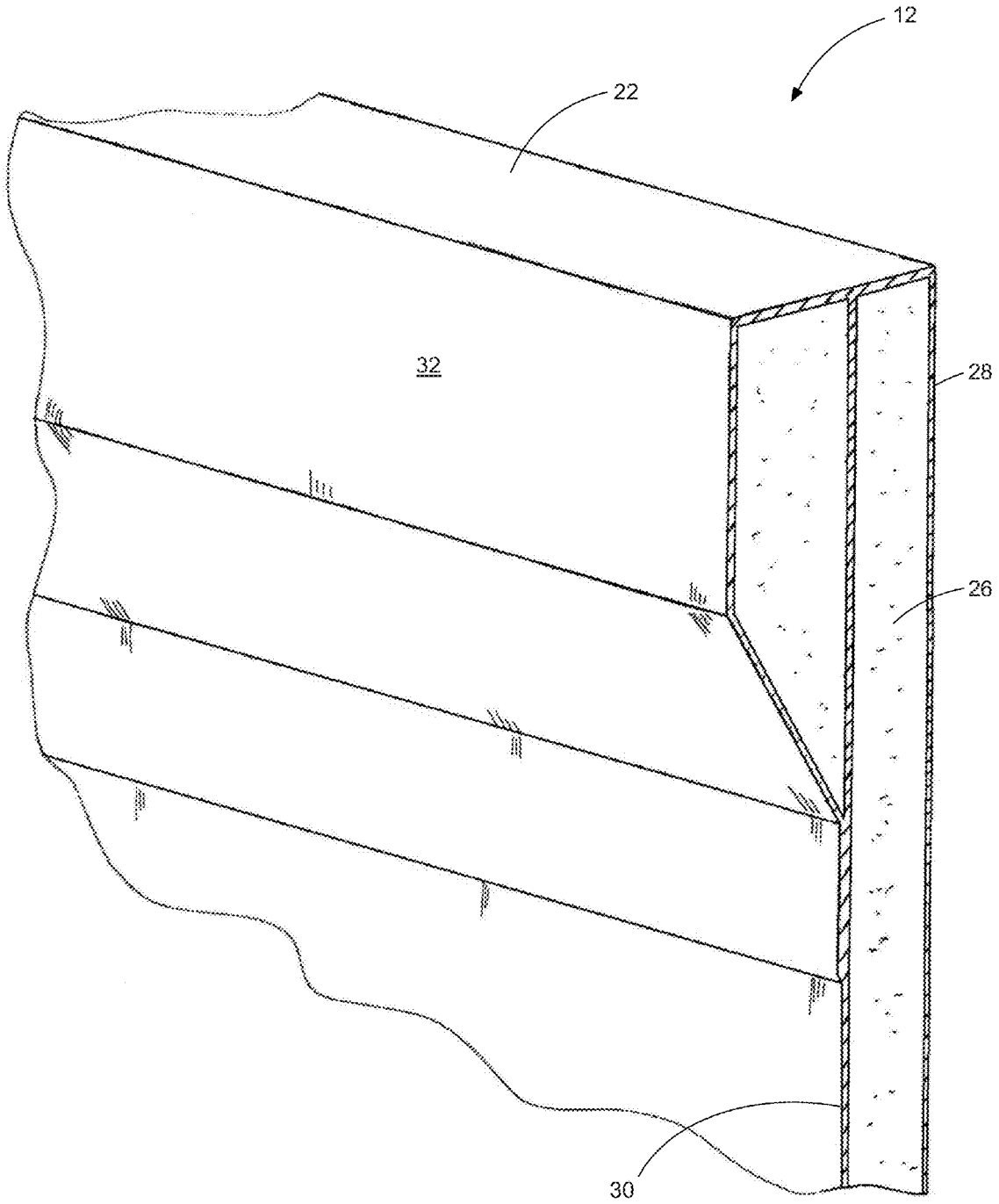
FIG. 4 is a partial sectional view of a top of the panel of FIG. 2.
Figure 5:
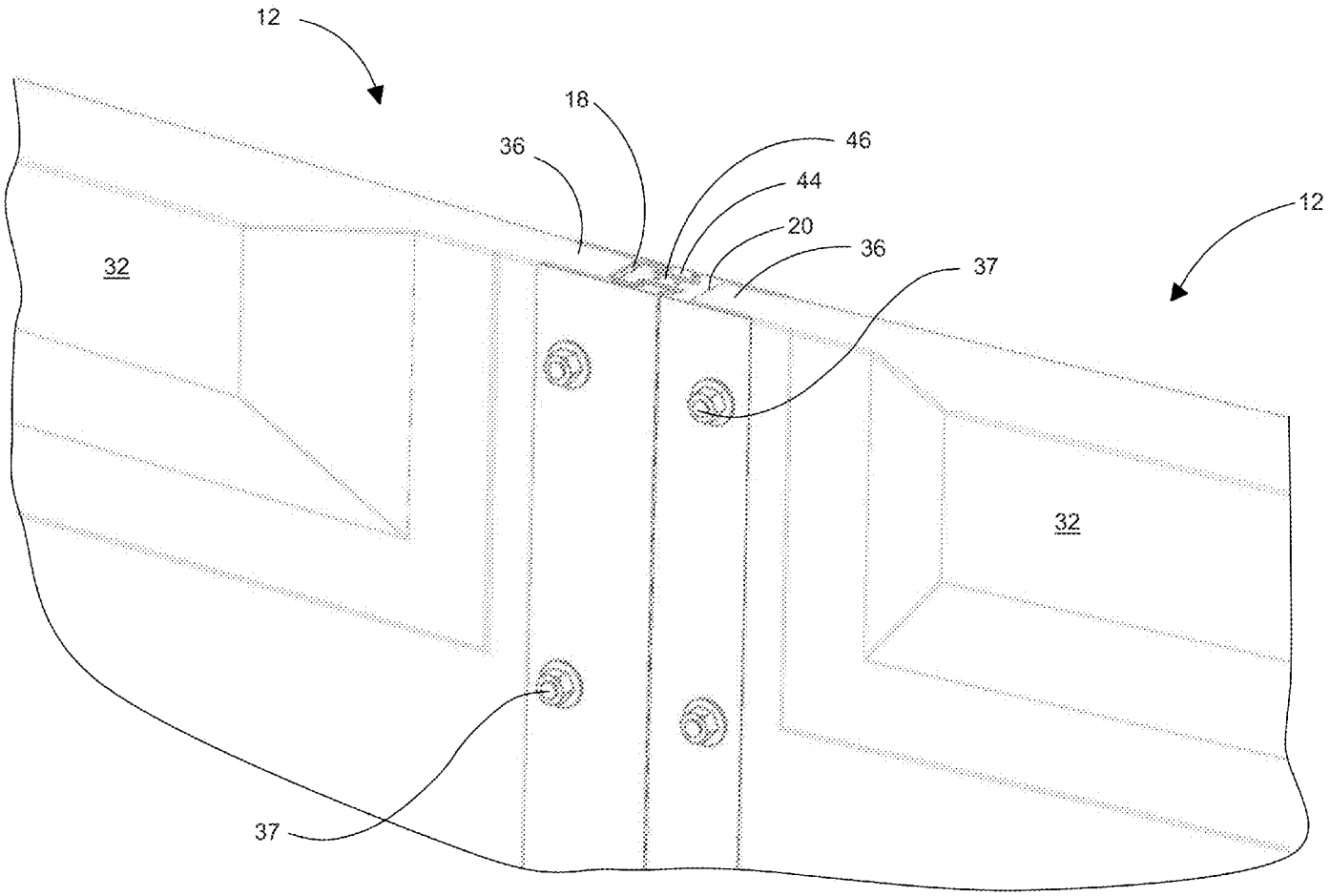
FIG. 5 is a partial section view of a top of adjacent panels according to FIG. 2, assembled using an embodiment of connectors described herein.
Figure 6:
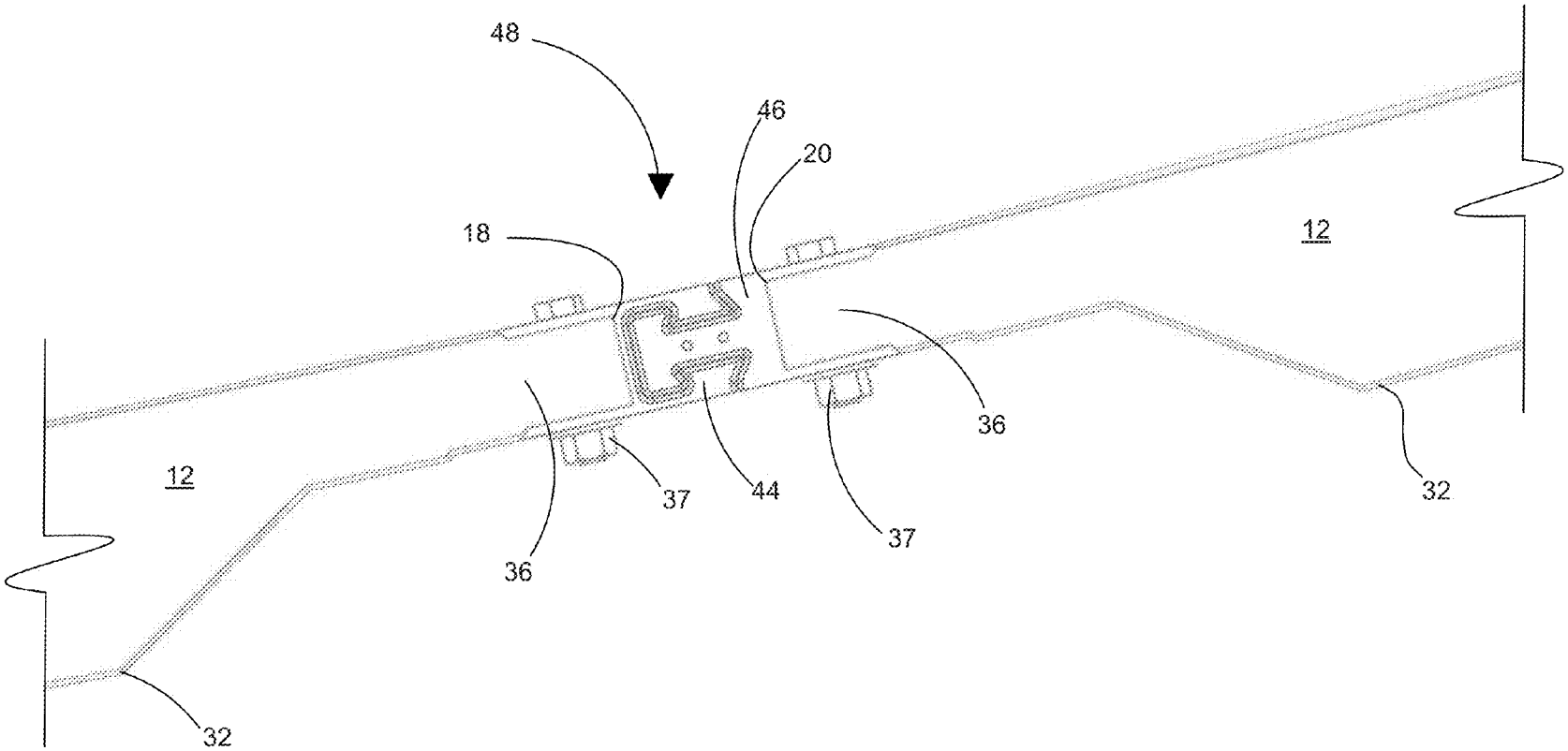
FIG. 6 is a plan view according to FIG. 5.

In an embodiment, as shown in FIG. 4, each panel 12 is a composite FRP panel which comprises a core 26, such as foam, and at least an inner skin 28 laminated and structurally bonded thereto. Assembled, the panels 12 are expected to support the hydrostatic loading of contained liquids F. Therefore the connectors 16, at least the inner skin 28 and the core 26 act together to support the hoop stress and other resulting loading. Accordingly the inner skin 28 has suitable tensile strength to take up hoop stress when placed in tension, such as when the assembled tank 10 is filled with liquid F. The inner skin 28 comprises engineered layers of fibers and resins to achieve the required strength.

In an embodiment, the inner skin 28 is formed of glass reinforced fiber polymer (GFRP) laminated to the foam core 26. The foam core 26 may further comprise GFRP shear webs laminated thereto.

In an embodiment, the arcuate panel 12 further comprises a protective outer skin 30, the foam core 26 being sandwiched and structurally bonded between the inner and the outer skin 28,30. The outer skin 30 is also a GFRP skin. 5. Thus, the core comprises an insulating material. The panel 12, so constructed, has a design thermal insulation value which negates the need for applying further insulation, such as spray foam, to the tank 10 after it is assembled. Insulation aids in preventing freezing of liquids stored therein.

As shown in FIGS. 2-4, the panel 12 further comprises an upper stiffening rib 32 formed circumferentially adjacent and below the top edge 22 of the panel 12 and a lower stiffening rib 34 formed circumferentially adjacent and above the bottom edge 24 of the panel 12. The upper and lower stiffening ribs 32,34 add sufficiently to the tensile strength of the panel 12, without a need for external steel bands such as found in the prior art to maintain structural integrity.

The stiffening ribs 32,34 aid to prevent buckling of the tank 10 during handling and under windy conditions when assembled and empty. Further, the stiffening ribs 32,34 protect the integrity of the panels 12, such as when the panels 12 are stacked for storage or transport, thus improving the overall safety of the tank 10 and the longevity of each panel 12, particularly about the bottom edge 24 of the tank 10 where leaking as a result of a loss of integrity is most likely to occur.

In embodiments, the upper and lower stiffening ribs 32,34 are formed of foam covered by a GFRP skin.

Figure 8:
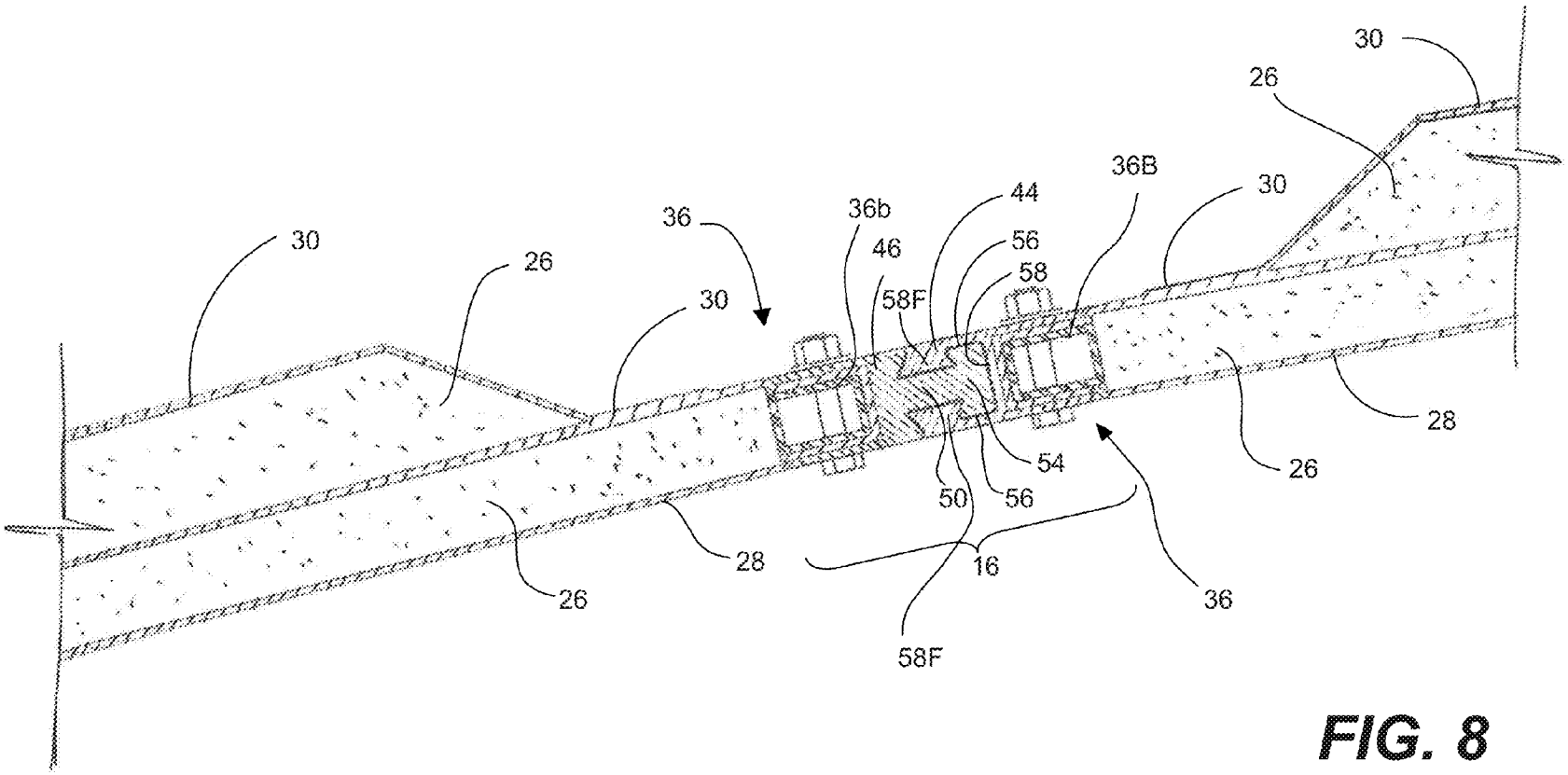
FIG. 8 is a sectional plan view according to FIG. 5.

Having reference to FIG. 8, shaped panel ends 36 are formed at each of the first and second ends 18,20. The panel ends 36 are an extension of the first and second ends 18,20 extending circumferentially outwardly in the same plane as the panel 12. The shaped panel ends 36 form a base to which the connectors 16 are fastened.

In an embodiment, the shaped panel ends 36 are formed of a structural member, such as a hollow metal beam 36*b* having a generally rectangular cross-section, each end beam 36*b* having a smaller depth than a depth of the panel 12. The panel ends 36 extend between the top and bottom edges 22,24 and are centered between the inner and outer skins 28,30.

Connectors 16 straddle the panel ends 36 and are fastened thereto, such as with nuts and bolts 37, the fastening being through the end beam 36*b*. The inner and outer skins 28,30 of the panel 12 extend over the end beams 36*b*. When assembled, the connectors 16 are substantially flush with the inner and outer skins 28,30. The connectors 16 can be unfastened from the panel ends 36 and replaced if worn or damaged during use.

Figure 7:
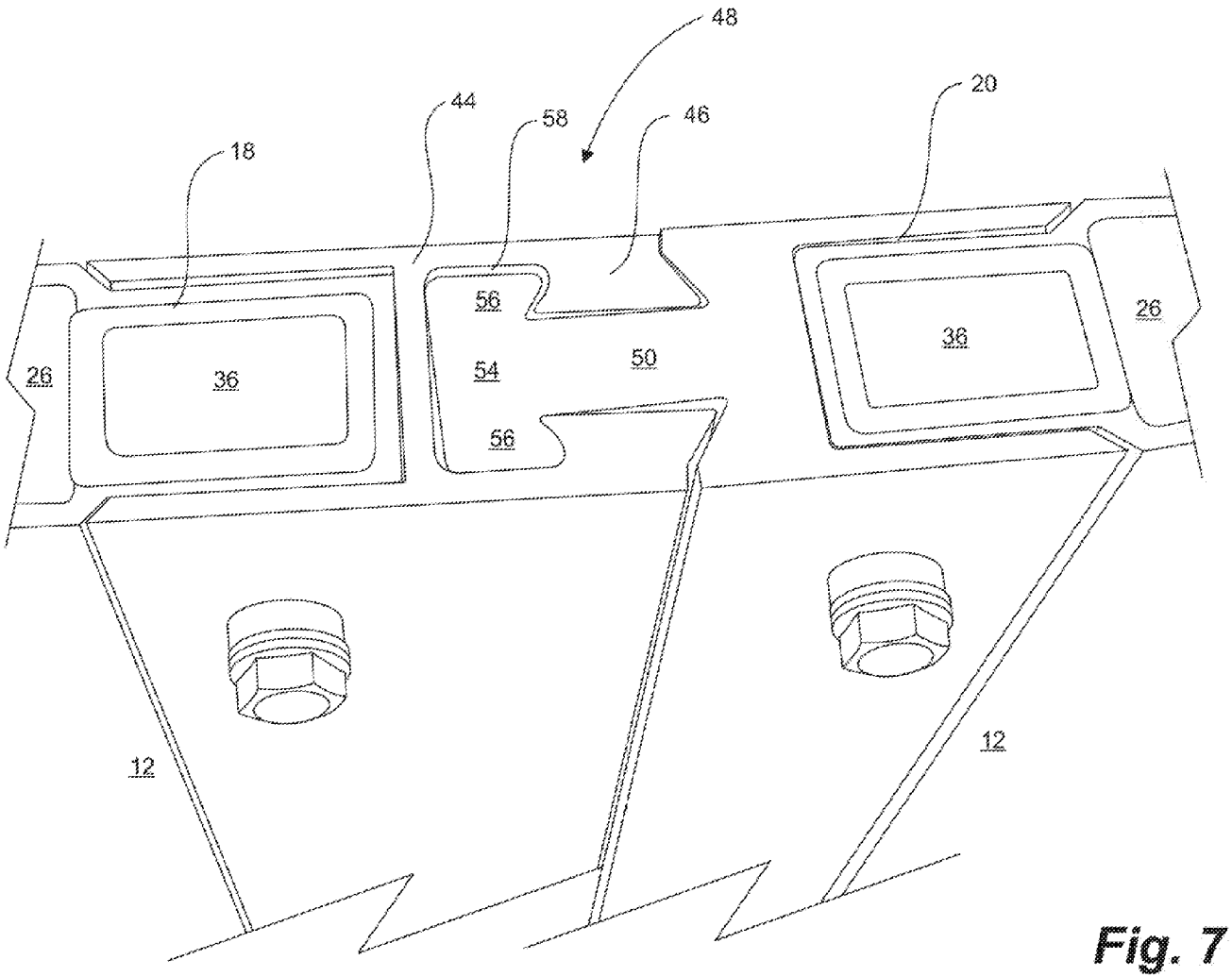
FIG. 7 is a detailed plan view according to FIG. 5.

In an embodiment, shown in FIGS. 7 and 8, the end beams 36*b* are elongate, rectangular tubular members 36*b*, such as rectangular, extruded aluminum tubulars, which are operatively connected to the foam core 26 along the first and second ends 18,20 and which are also covered with the GFRP skin 28,30. The extruded aluminum tubular end beams 36*b* can be removed from between the skins 28, 30 and new tubular end beams 36*b* inserted therein for replacement if damaged during use.

Figure 9:
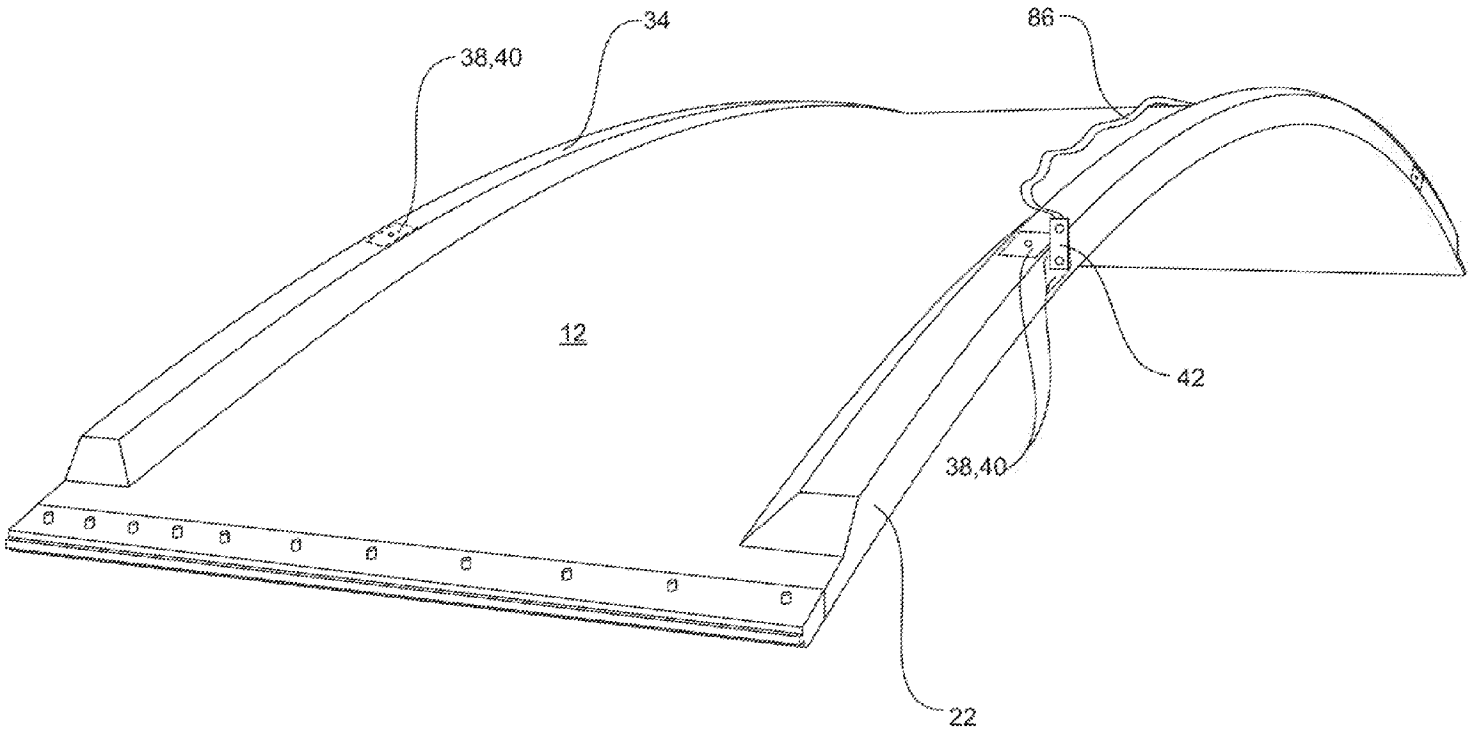
FIG. 9 is a perspective view of a panel according to FIG. 2, supported horizontally on a surface and having ropes installed on shackles for lifting the panel for assembly with like panels.
Figure 10:
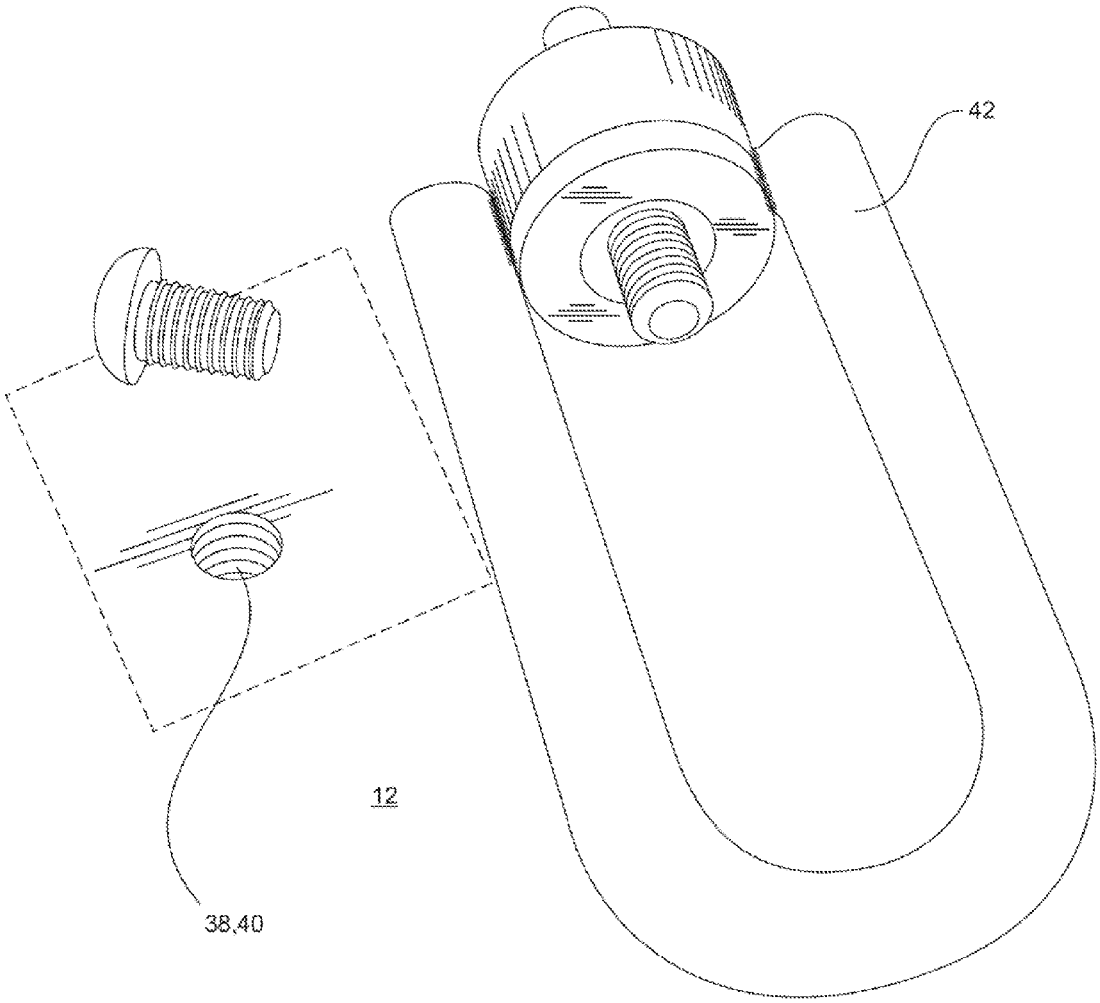
FIG. 10 is a perspective view of a shackle threaded into and used for lifting the panel according to FIG. 9 and further illustrating threaded connections into reinforcement plates embedded in the panel, as shown in dotted lines.

As shown in FIGS. 9 and 10, each of the panels 12 further comprises reinforcements 38, spaced along the edges 22,24 and in the upper and lower stiffening ribs 32,34 of each panel 12 and embedded therein as lifting engagement means or connection points to aid in handling of the panel 12. The reinforcements can be small, stainless steel plates 40 embedded or formed internal to the panels 12, and which have a fastener provided therein to permit connection of removable eye hooks or shackles 42 used for lifting the panels 12 on and off the truck bed, and for positioning and aligning the panels 12 for connection therebetween during assembly of the tank 10.

In an embodiment, six reinforcement plates 40 are used, two spaced along the top edge 22 of the panel 12 and two in each of the top and bottom stiffening ribs 32,34 of the panel 12. The reinforcement plates are structural and capable of holding greater than 5 times the weight of the panel 12.

In embodiments, as shown in FIG. 10, the stainless steel plates 40 are internal to the panel 12 and are threaded to accept threaded shackles 42. The plates 40 are positioned equidistant either side of the panel's center of gravity so as to balance the panel 12 when the shackles 42 are engaged and the panel 12 is lifted.

Figure 11:
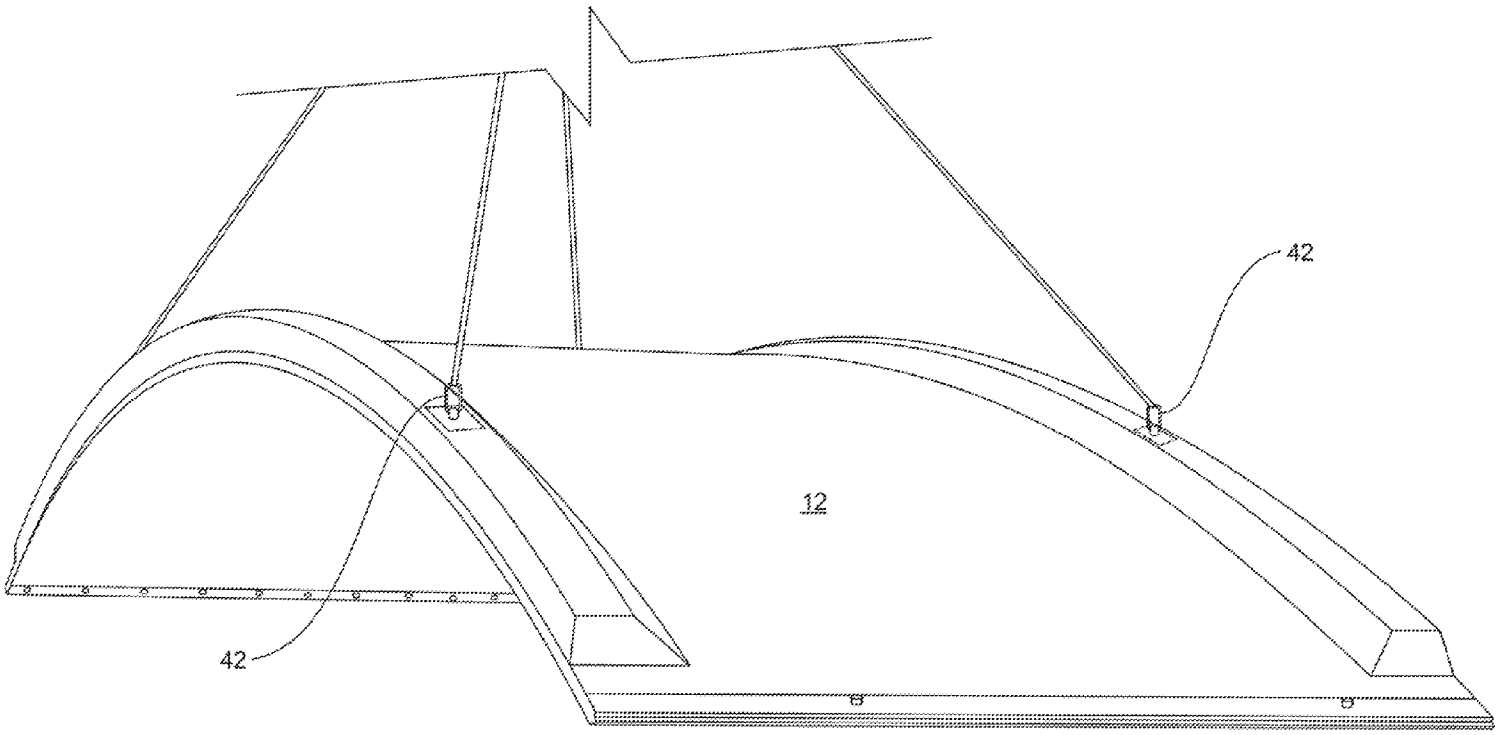
FIG. 11 is a perspective view of ropes engaging between a crane (not shown) and shackles positioned about a center of gravity of the panel in stiffening ribs adjacent a top and bottom edge of the panel for four-point lifting on and off a truck bed or storage surface.
Figure 12:
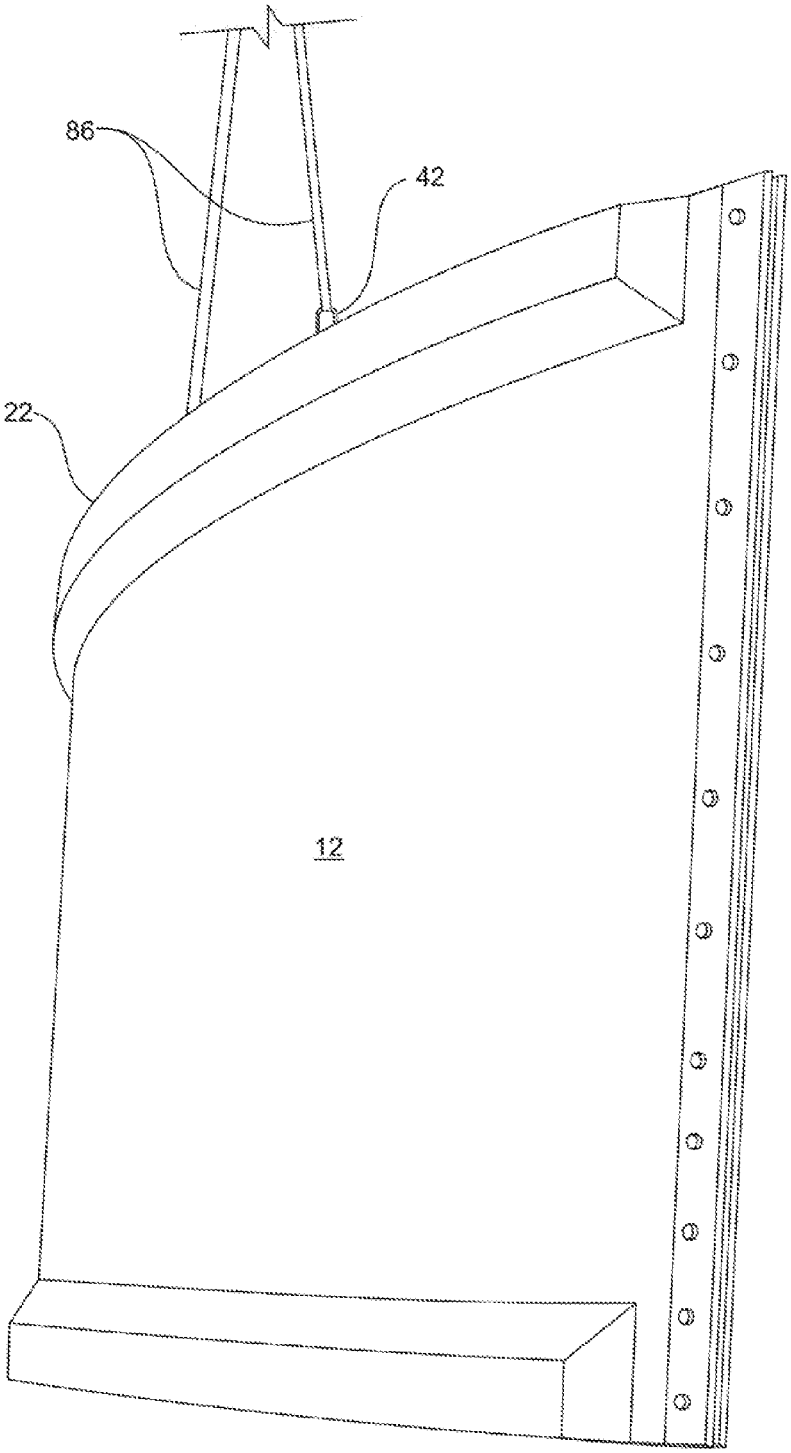
FIG. 12 is a perspective view of ropes engaging between a crane (not shown) and shackles positioned about a center of gravity of the panel on a top edge of the panel for two-point lifting for assembly, the panel being suspended substantially vertically therefrom.

As shown in FIG. 11, during lifting on and off the truck, shackles 42 are threaded to the reinforcement plates 40 on the top and bottom stiffening ribs 32,34 and are engaged to permit a four-point lift, the panel 12 being in a generally horizontal position. As shown in FIG. 12, during installation, shackles 42 are threaded into the reinforcement plates 40 on the top edge 22 of the panel 12 and are engaged so that the panel 12 can be suspended substantially vertically, such as from ropes connected to a crane, for alignment with another of the panels 12 during assembly therewith. The panel 12 hangs vertically for parallel alignment of the elongate female connector of one panel with the elongate male connector of an adjacent panel.

Advantageously, while being lightweight as a result of the composite structure of the panels 12, the panels 12 also comprise little if any exposed steel and therefore issues related to corrosion are largely absent.

Connectors

With reference to FIGS. 2 and 5-8, the connectors 16 further comprise an elongate female connector 44 which extends along the first end 18 of the panel 12 and an elongate, male connector 46 which extends along the second end 20 of the panel 12. The female and male connectors 44,46 are complementary to permit interconnection with adjacent, like panels 12 for assembling the tank perimeter 14. The male and female connectors 44,46, when interconnected, form a dovetail-type or tongue-and-groove type joint 48 which locks circumferentially therebetween, but permits sliding axial engagement and disengagement of the male and female connectors 44,46 to allow assembly and further to permit an assembled panel 12 to misalign vertically with respect to adjacent panels 12. Vertical misalignment permits adjacent panels 12 to remain vertical despite support on an uneven surface S.

In an embodiment, the elongate male connector 46 is a generally T-shaped tongue 50 having a neck portion 52 which extends outwardly from the panel end 36 and in the same plane as the panel 12 and a head portion 54 which extends generally perpendicular thereto. As shown in FIG. 8 and FIGS. 13A-13C, opposing ends 56 of the head portion 54 are curved inward toward the panel 12 and the panel end 36.

The female connector 44 comprises a channel or groove 58 formed therealong between opposing and parallel fingers 58F,58F. The groove 58 is complementary or corresponds in shape with the generally T-shaped tongue 50 for engagement or coupling therewith. When the tongue 50 is engaged within the groove 58, the adjacent panels 12,12 are locked circumferentially as the curved opposing ends 56 of the head portion 54 cannot be pulled circumferentially out of the groove 58.

Figure 13A:
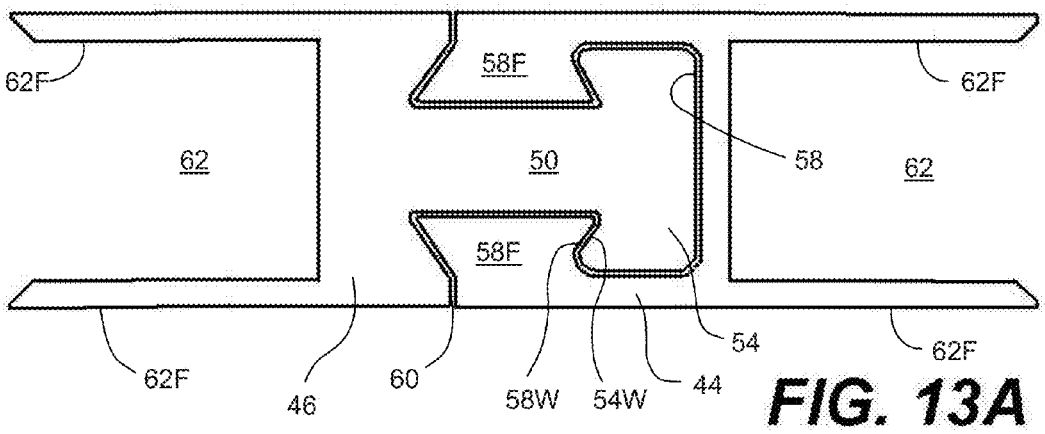
FIGS. 13A-C are plan views of a tongue of a male connector engaging a groove of a female connector forming a tongue-and-groove joint and more particularly.
Figure 13B:
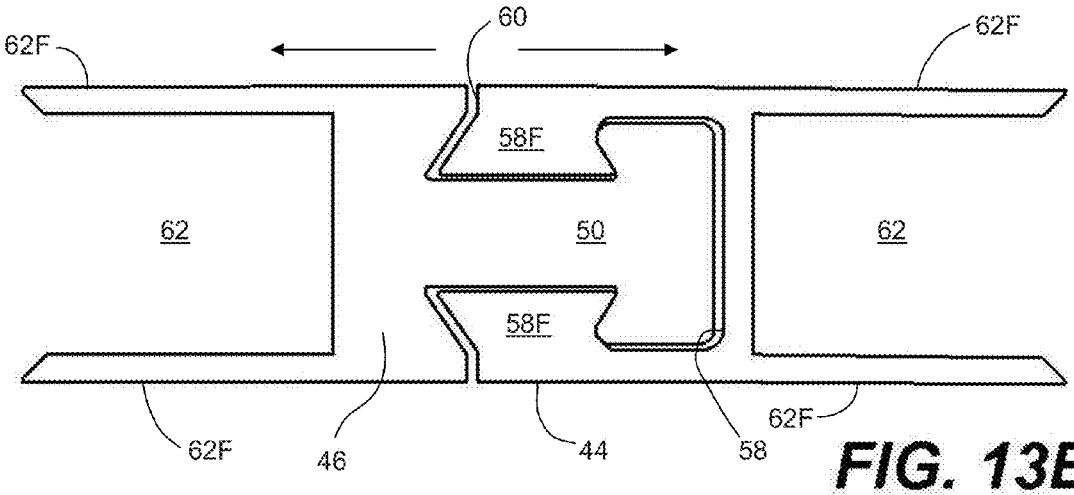
Figure 13C:
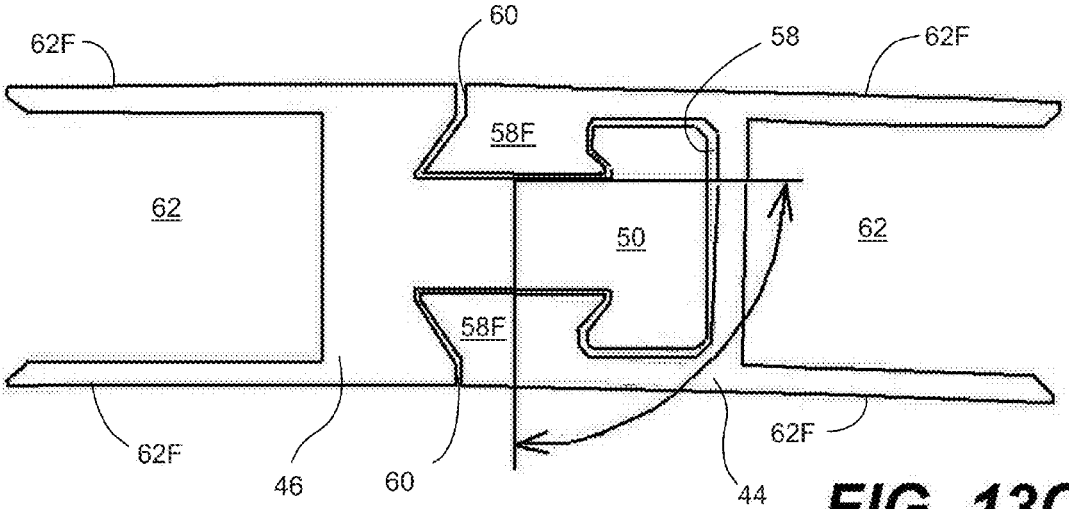

As shown in FIGS. 13A-13C, to prevent forcible removal from one another, and in particular the forcible spreading of the opposing finger 58F,58F under circumferential loading to release of the tongue 50, the complementary connectors 44,46 can have a configuration shaped to encourage a gripping engagement.

Each head portion 54 has a mushroom head shape forming angular wing portions 54W,54W that face each other forming an inside dovetail groove and an outside dovetail groove. Opposing ends or wing portions 54W,54W of the head portion 54 are angled inward toward a centerline of the panel 12. The groove 58 has complementary wing portions 58W,58W forming complementary inside and outside dovetail-shaped portions. When the head wing portions 54W circumferentially pull on the groove wing portions 58W, the fingers 58F are driven inwardly, towards each other gripping the tongue 50 even more strongly. Thus, the curved opposing ends 56 of the head portion 54 cannot be pulled circumferentially out of the groove 58.

Further, as shown in FIGS. 13A-13C, a gap 60 is formed between the tongue 50 and the groove 58 when interconnected. When the panels 12 are not in tension (FIG. 13A), the gap is uniform therebetween, such as about 0.050 inches. When the panels are in tension (FIG. 13B), such as when the tank 10 is filled with fluid F, the gap 60 increases, such as to a maximum of about 0.106 inches except where the curved opposing ends 56 bottom out on the groove 58. As shown in FIG. 13C, during assembly, when the panels 12 are joined together to form a generally cylindrical containment, the interconnected female and male connectors 44,46 and gap 60 therebetween permit a limited rotation of the tongue 50 within the groove 58 allowing adjacent panels 12 to swing laterally within a constrained arc radius relative to one another.

The limited rotation between the female and male connectors 44,46 allows the panels 12 to engage even when the panels 12 are not perfectly aligned during assembly and further permit embodiments of the tank 10 having multiple radii. For example, fewer panels 12 result in a smaller diameter tank 10 while a larger number of panels 12 result in a larger diameter tank 10. During assembly, the panels 12 may not be assembled in a perfect circle however when fluid fills the tank, the panels 12 are forced into a substantially perfect circle with the limited rotation at the interconnected female and male connectors 44,46.

Best seen in FIGS. 7 and 13A-13C, each of the female and male connectors 44,46 further comprise an elongate rectangular recess 62 extending from a top to a bottom therealong, opposing the tongue 50 or the groove 58. The recess is bounded by spaced, opposing and parallel flanges 62F,62F. The rectangular panel end 36 fits within the recess 62 between the two flanges 62F,62F and the connectors 16 are fastened transversely therethrough, such as using nuts and bolts 37, extending through one flange 62F, through the end beam 36*b* and through the opposing flange 62F, for secure connection to the panel ends 36. Thus, the connectors 16 can be easily changed if the connectors 16 are damaged during use.

Generally the connectors 16 are extruded or other manufactured elongate shapes of unitary cross-section formed to incorporate the spaced flanges 62F,62F and the respective female and male connector 44,46 components. In embodiments, the connectors 16 are made from extruded anodized aluminum which is light weight and will not corrode.

As noted above, the flanges 62F,62F of the connectors 16, when bolted to the panel ends 36, are substantially flush with the inner and outer skins 28,30 of the panel 12.

As one of skill will appreciate, while described herein in the context of use with FRP panels, embodiments of the female and male connectors 44,46 are also applicable for use with tanks 10 formed using panels constructed of other materials, such as steel.

Liner

Once assembled, the tank 10, engaged with the surface S, typically the ground, about the entirety of the bottom edge 24 of the three or more panels 12 can be used to hold fluid F, the ground S acting as a floor of the tank 10.

Where the panels 12 do not completely seat on the ground S however, a liner 70 can be used within the tank 10. As with conventional steel tanks where a liner is used, conventional clamps may be used to retain the liner 70 in the tank 10. While the tank 10 may be reused onsite, typically the liner 70 is replaced with each use.

Figure 14:
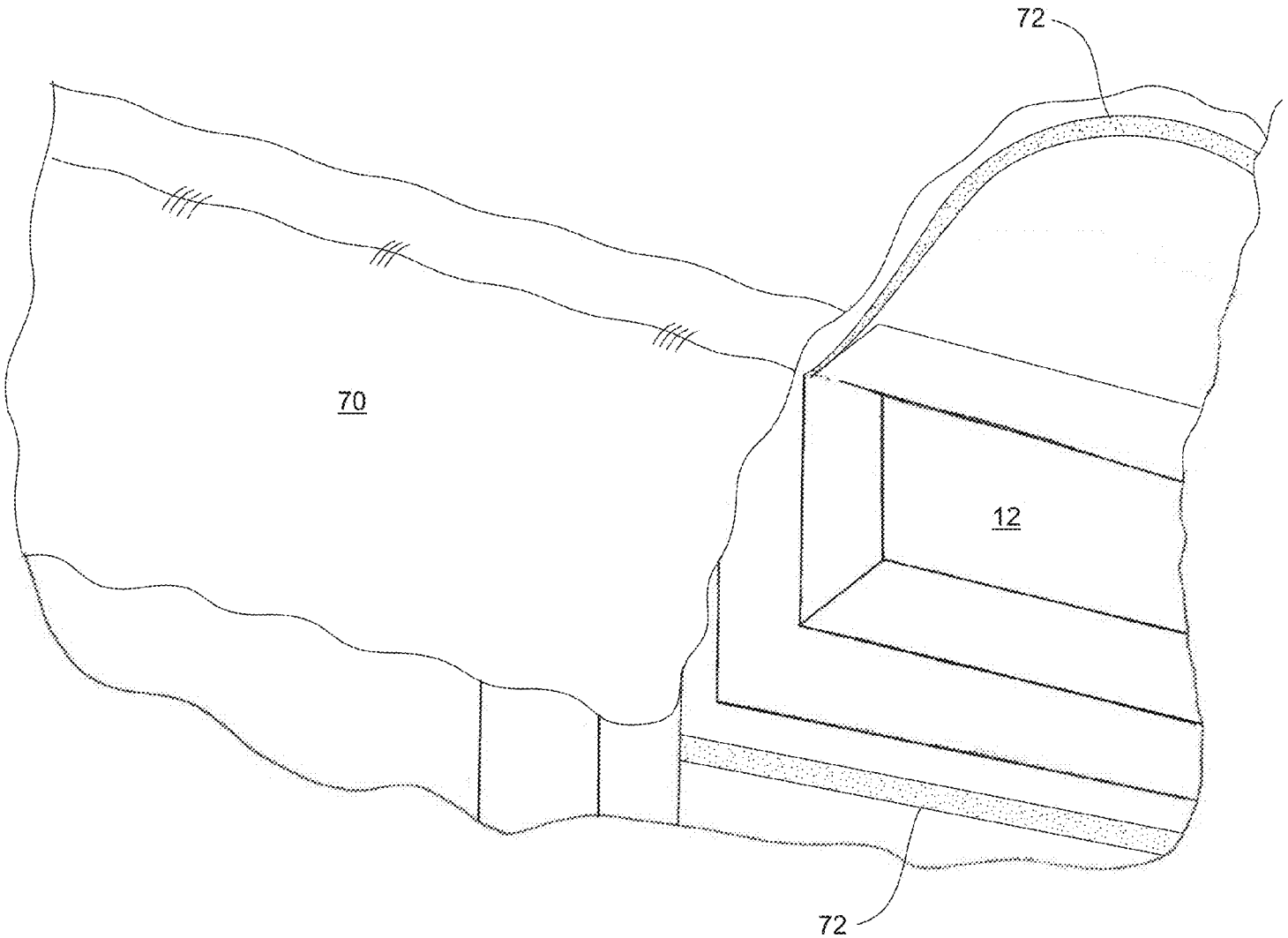
FIG. 14 is a perspective view illustrating a liner engaged within the tank using hook and loop fastener such as when there are gaps between a bottom edge of the tank and the ground surface on uneven ground.

In embodiments disclosed herein, as shown in FIG. 14, the liner 70 can be attached using an industrial, flexible, and reusable hook and loop material 72 which can be pre-attached to the tank panels 12 and to the liner 70 to permit safer, less time consuming attachment to the tank 10. Typically, the liner 70 extends over the top edge of the tank panels 12, such as about 2 to 3 feet. The hook and loop material 72 is attached to the outer skin 30 of the panel 12 below the top edge 22 of the panel 12 and to the side of the liner 70 adjacent thereto.

More robust attachments can include clamps (not shown) that sandwich the liner about the top edge 22 of the panel 12.

Leak Monitoring

In embodiments, a leak detection and monitoring system, such as is known in the art, can be installed to monitor the tank integrity.

Transport and Assembly

Figure 15B:
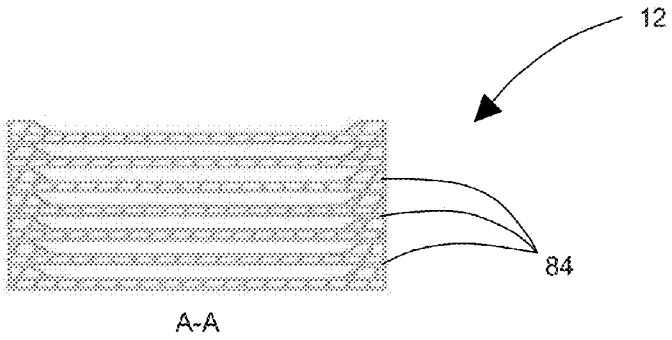
FIGS. 15A and 15B illustrate a stack of like panels according to FIG. 2, stacked for transport and storage, more particularly.
Figure 15A:
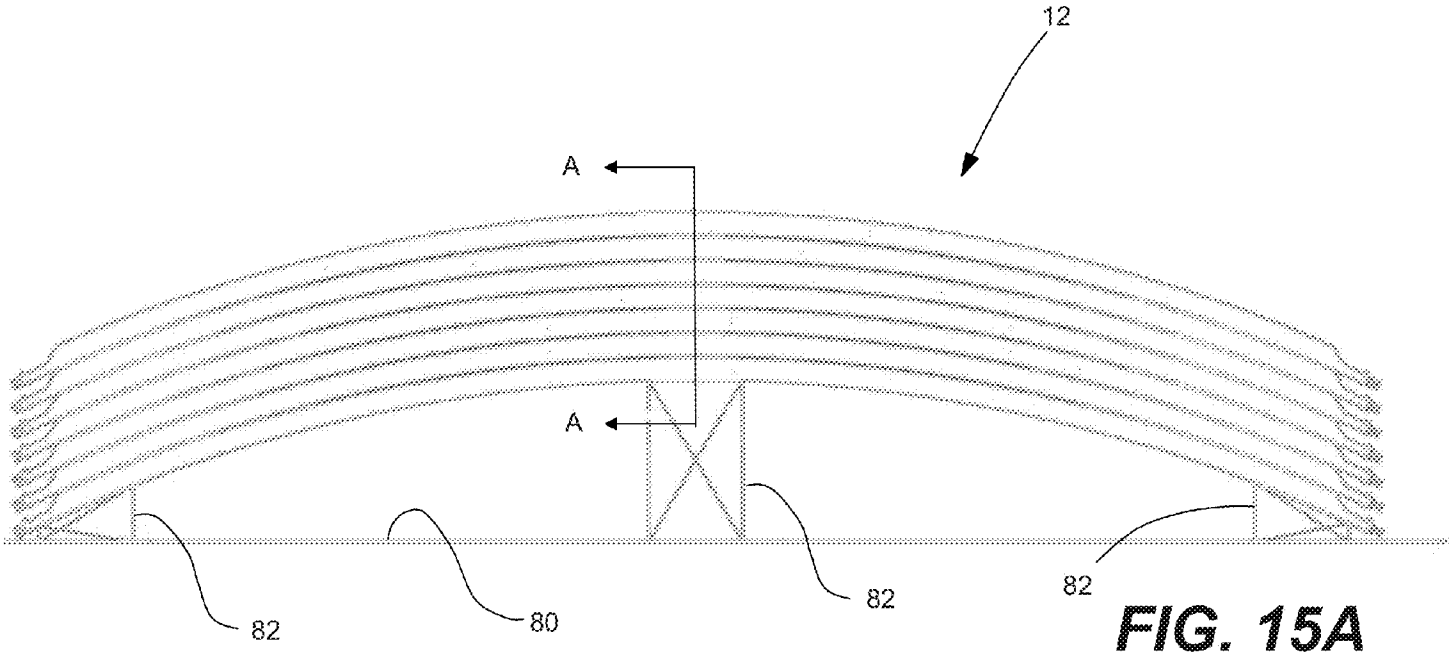

Embodiments disclosed herein are assembled in the field, such as at a well site location. As shown in FIG. 15A and 15B, sufficient arcuate panels 12 to form a tank 10 of the required volume are stacked on a truck bed 80, such as on a standard 48' flatbed truck. Due to the stability and lightweight panel design, the stacked panels 12 meet regulations for the maximum dimension and weight limitations for highway transport.

Additionally, cribbing 82 may be used between the truck bed 80 and the panels 12 to support the stacked panels 12.

Further, neoprene strips 84 may be positioned between the panels 12, as the panels 12 are stacked, to avoid damage to the panels 12 during the transport.

Once onsite, having reference again to FIGS. 9 and 12, guide ropes 86 connected to a crane (not shown) are connected to the shackles 42 on the top edge 22 of each panel 12. The panels 12 are then lifted by the crane, one at a time, for assembly. A first panel 12*f* is placed with the bottom edge 24 supported on the ground S, the opposing ends 18,20 being substantially vertical thereto.

Figure 16:
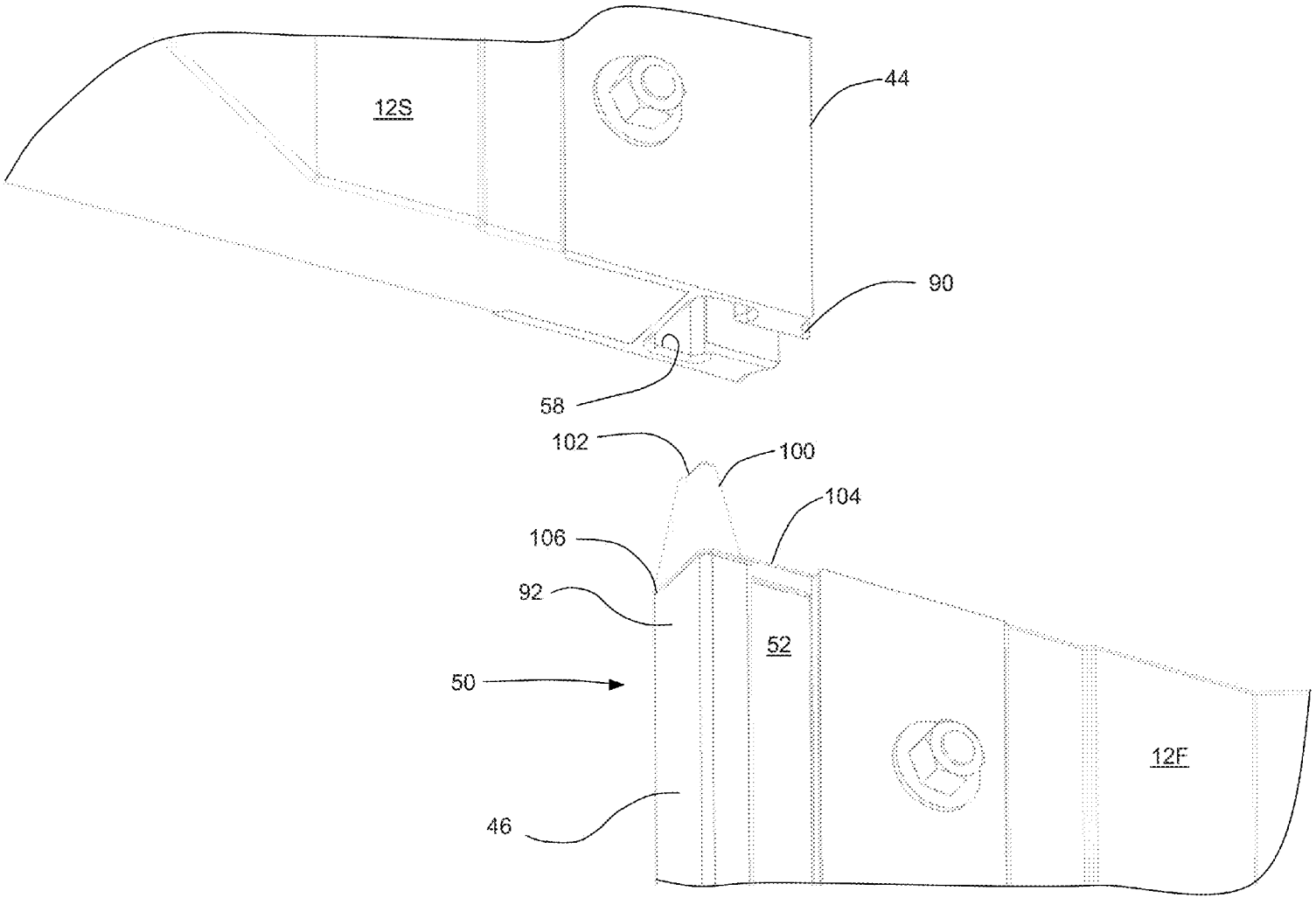
FIG. 16 is a partial perspective view of a first panel having a temporary male guide installed thereon and a second panel aligned for engagement of the groove with the male guide and tongue of the first panel.
Figure 17:
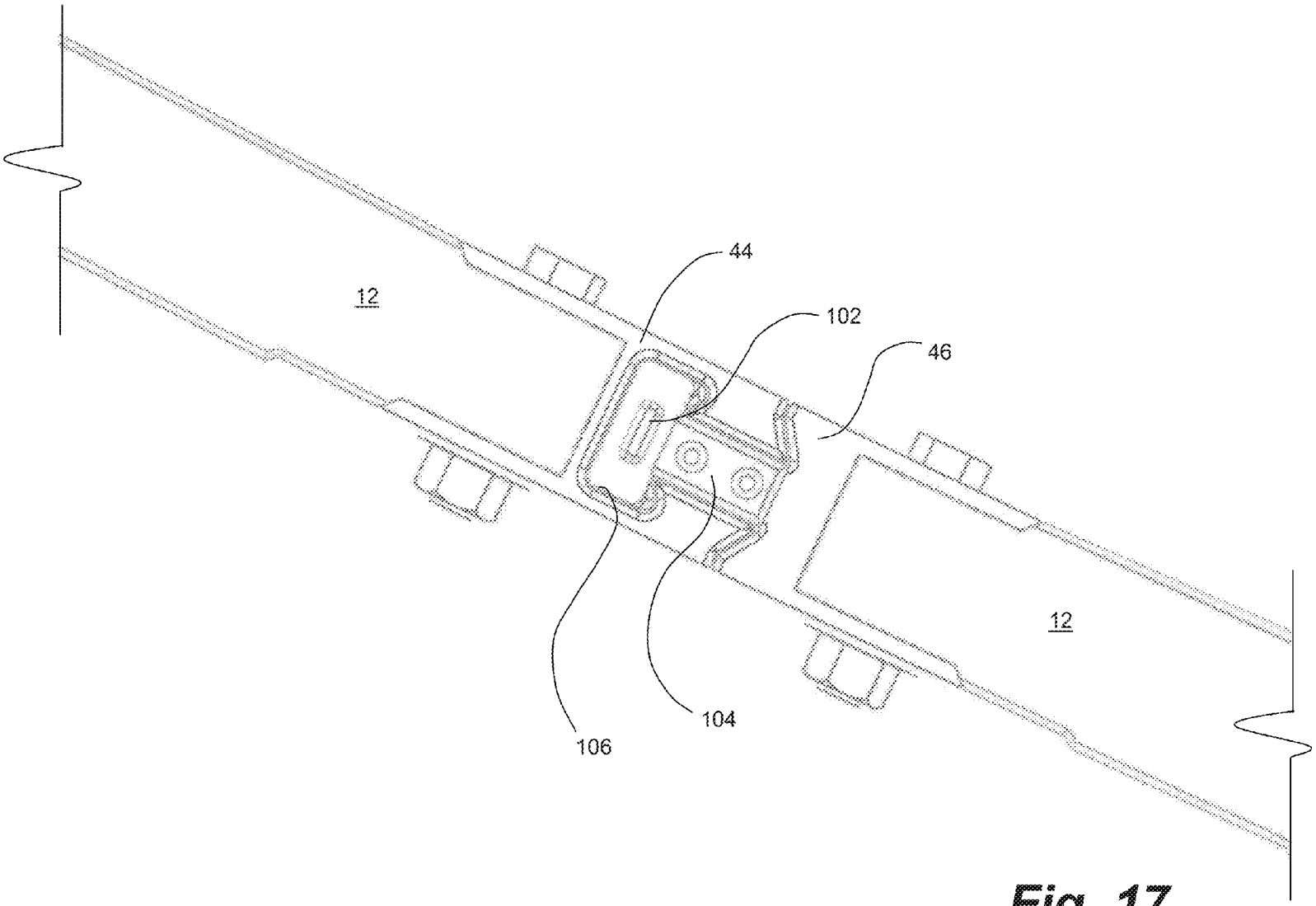
FIG. 17 is a plan view of the first and second panels according to FIG. 16 when assembled and prior to removal of the male guide installed thereon'
Figure 18:
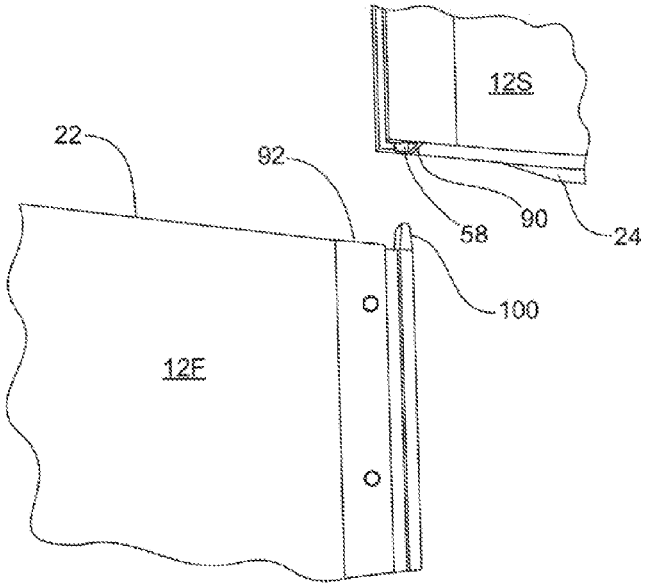
FIGS. 18 to 26 are perspective views illustrating the method of interconnecting the male connector of one panel with the female connector of an adjacent panel, more particularly.
Figure 19:
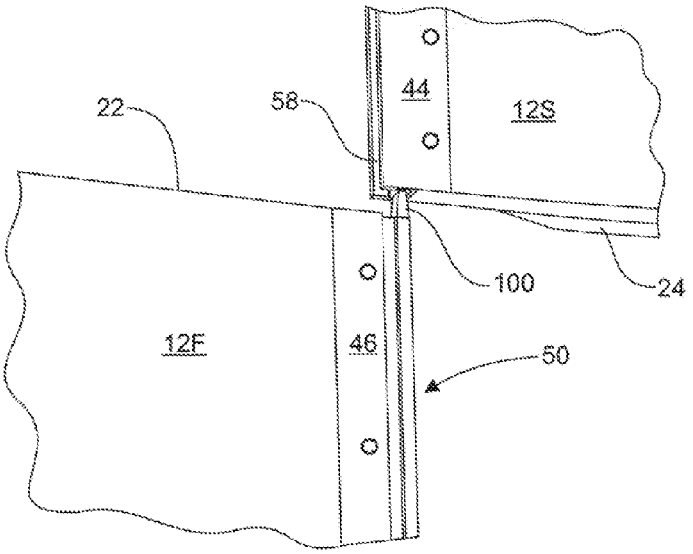
Figure 20:
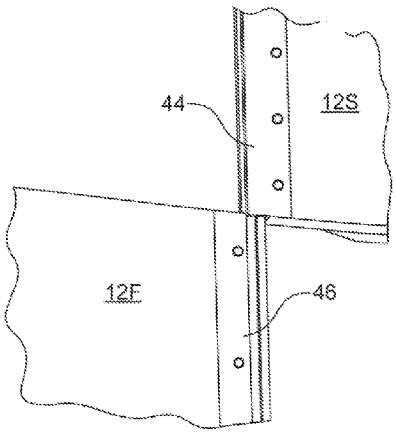
Figure 21:
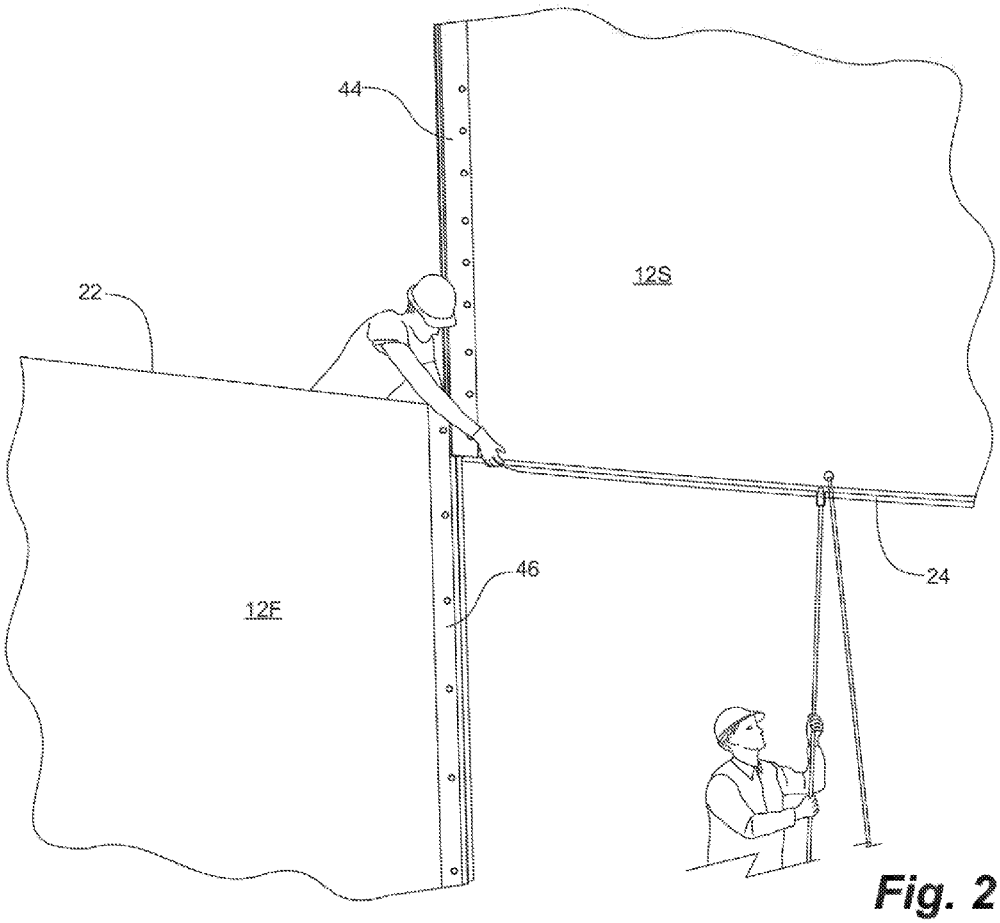
Figure 22:
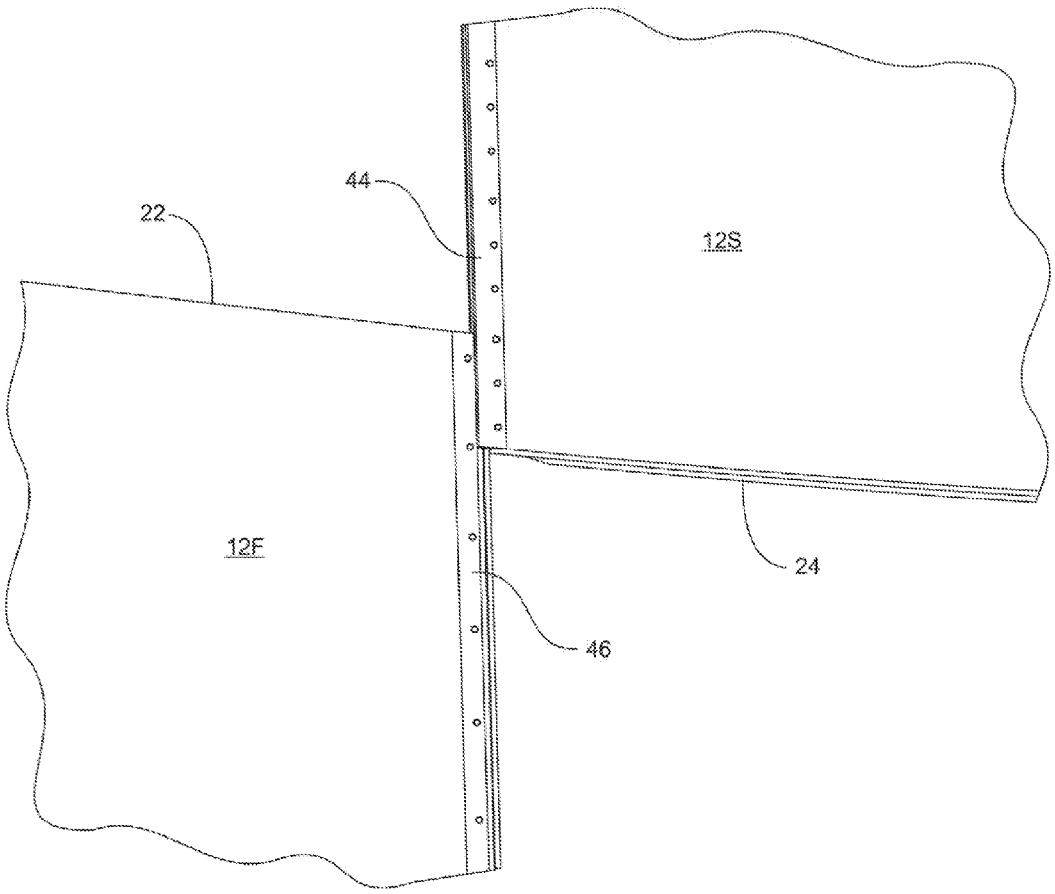
Figure 23:
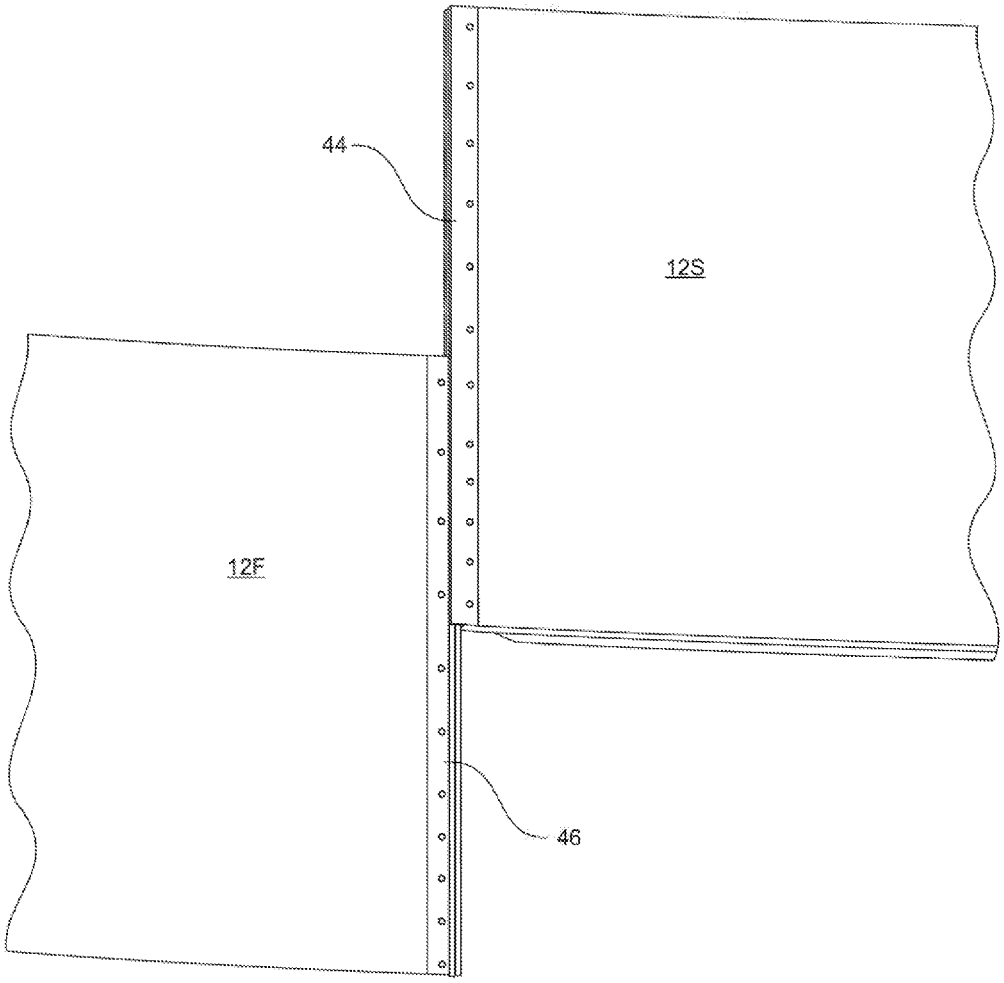
Figure 24:
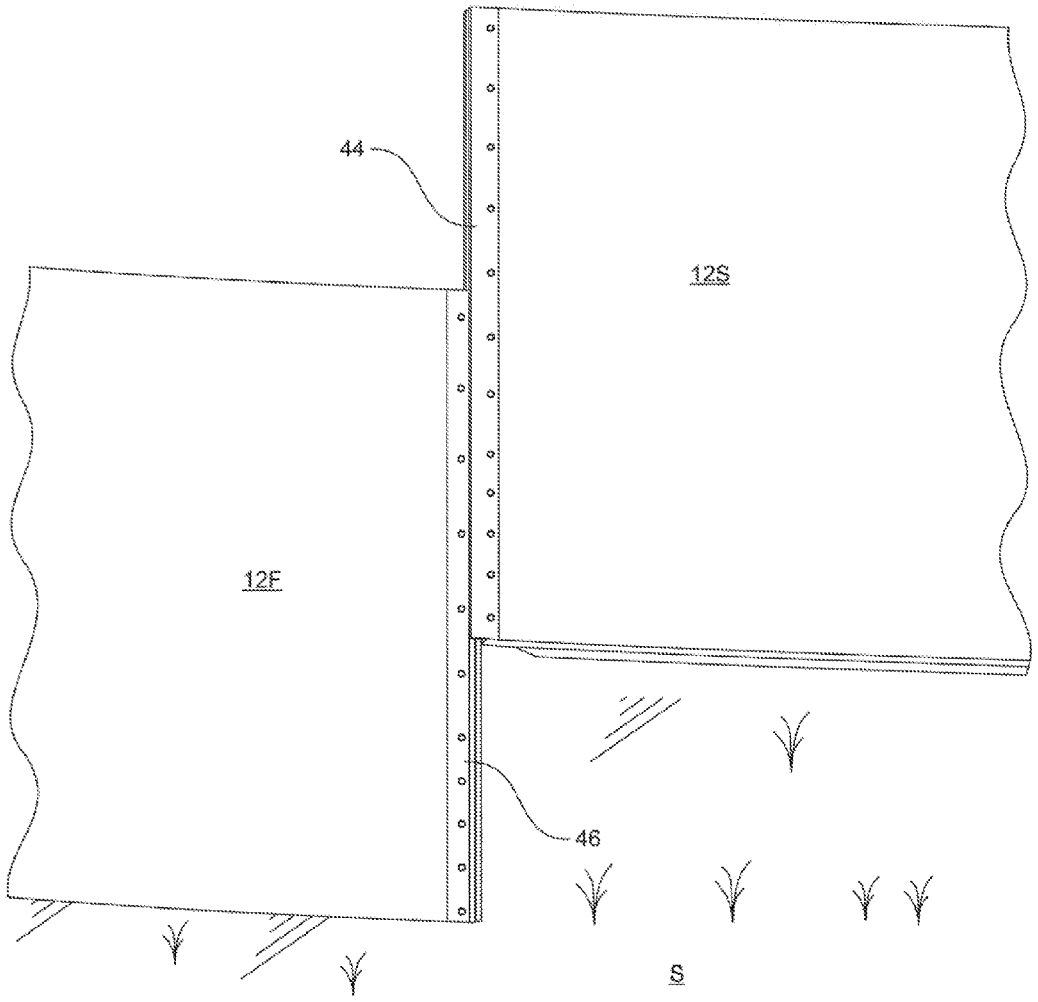
Figure 25:
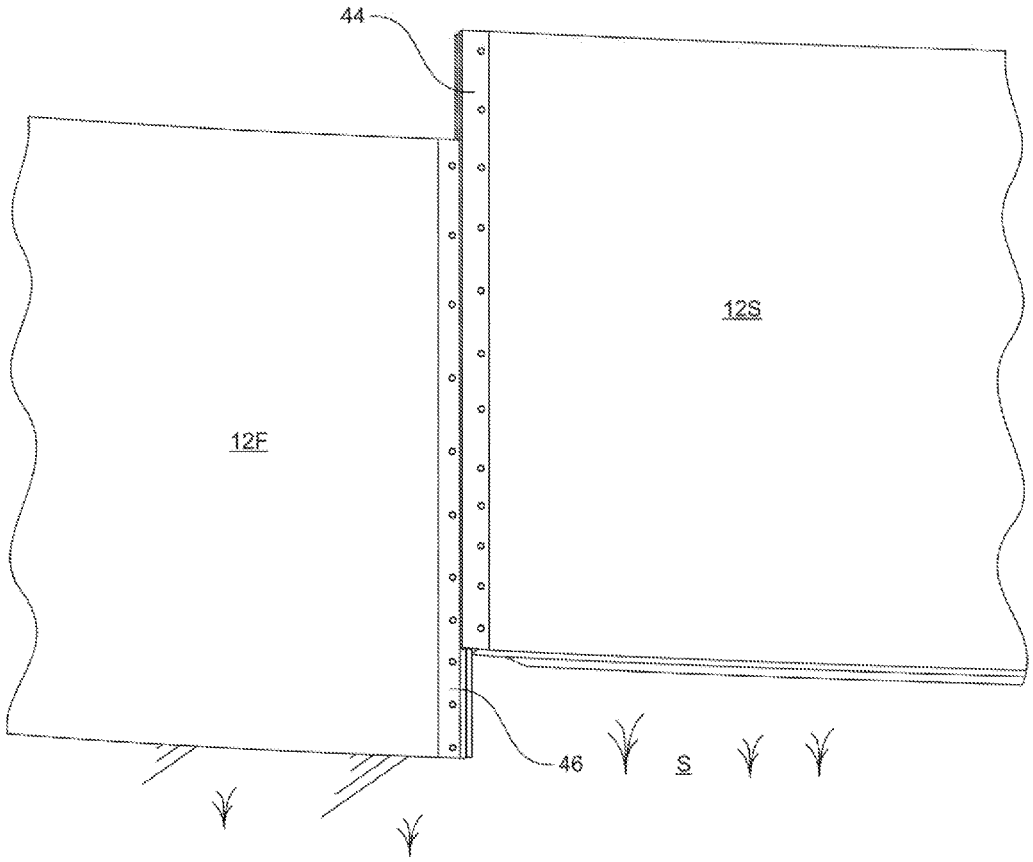
Figure 26:
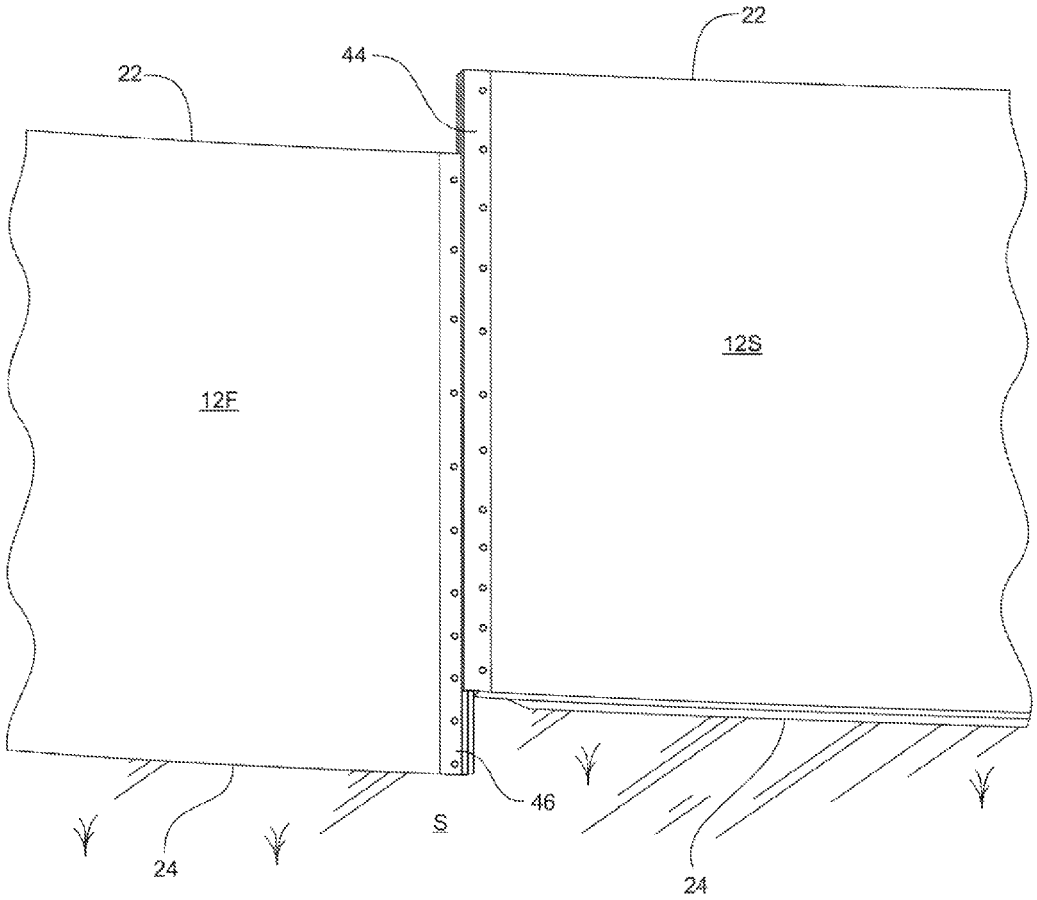

As shown in FIG. 16, a second panel 12*s* is lifted above and offset the first panel 12*f*, a bottom 90 of the shaped groove 58 of the female connector44 of the second panel 12*s* being aligned with a top 92 of the male connector 46, particularly the co-operating shaped tongue 50, of the first panel 12*f*. The second panel 12*s* is lowered to axially engage the tongue 50 and groove 58.

In embodiments, as shown in FIGS. 16-19, a male guide 100 is temporarily connected to the top 92 of the male connector 46 of the first panel 12*f* for providing tolerance in two directions for alignment of the tongue 50 in the groove 58 of the adjacent second panel 12*s*. The male guide 100 is generally a right rectangular, pyramidal-shaped member having an apex 102 directed upwardly from the panel 12 for insertion into the groove 58 of the female connector 44. The male guide 100 has a flange 104 connected to a base 106 thereof for connection, such as to the neck portion 52 of the tongue 50.

The work crew guides the suspended, bottom end 90 of the shaped groove 58 over the temporary male guide 100 as the second panel 12*s* is lowered thereon.

As shown in FIGS. 20-26, the second panel 12*s* is lowered until at least a portion of the lower edge 24 of the second panel 12*s* rests on the ground S. The male guide 100 can be removed from the first panel 12*f* when the female and male connectors 44,46 are engaged axially therealong.

To further aid axial alignment between the female and male connectors 44,46 during assembly, graphite spray may be used to lubricate the connectors 16.

The above process is repeated until a last panel 121 of the three or more panels 12 is to be positioned for assembly.

Figure 27:
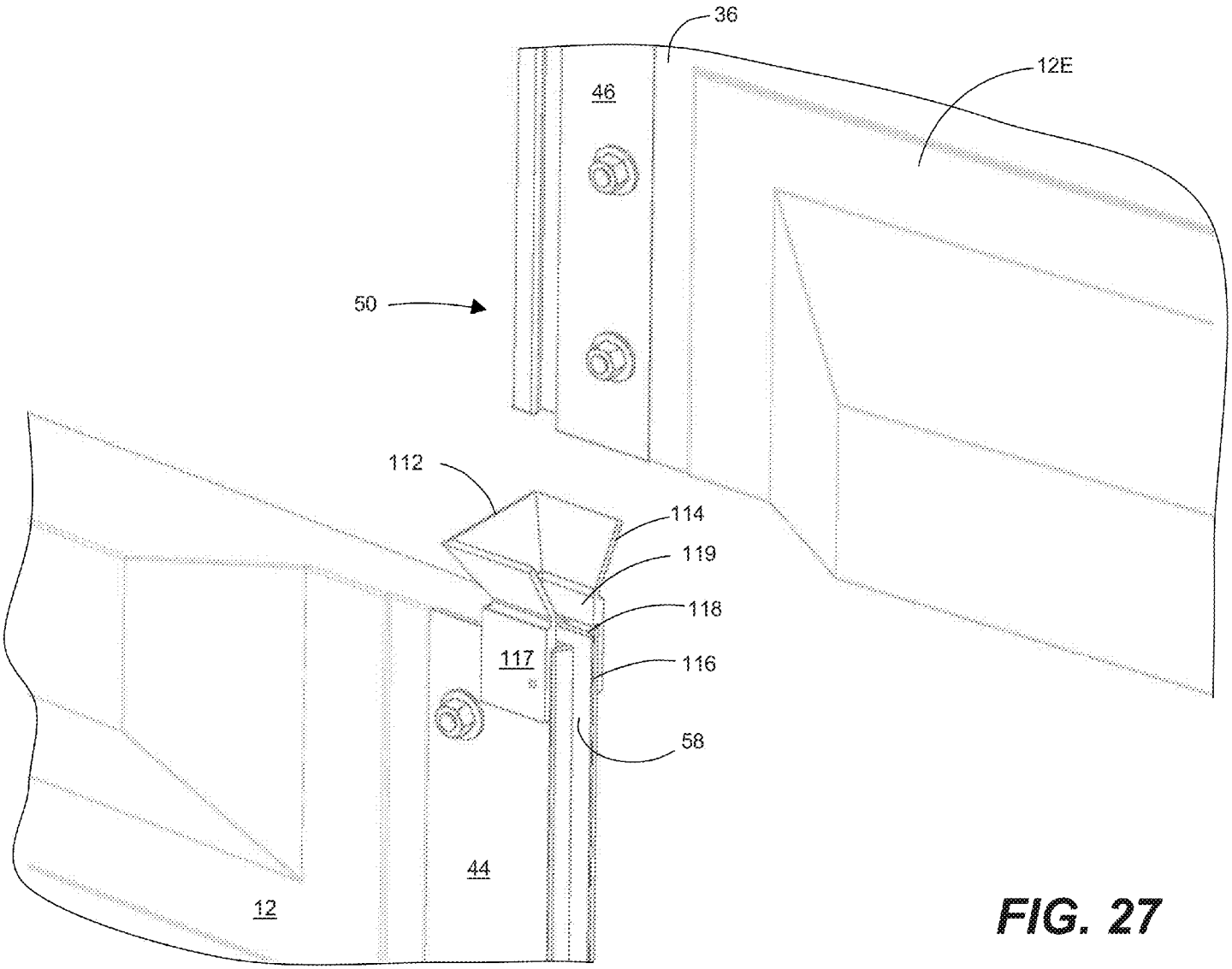
FIG. 27 is a perspective view of a temporary female guide installed on the groove of the female connector of an adjacent already-assembled panel as a last of the panels is aligned for insertion of the tongue of the male connector of the last panel into the temporary female guide and groove of the already-assembled, adjacent panel.
Figure 28A:
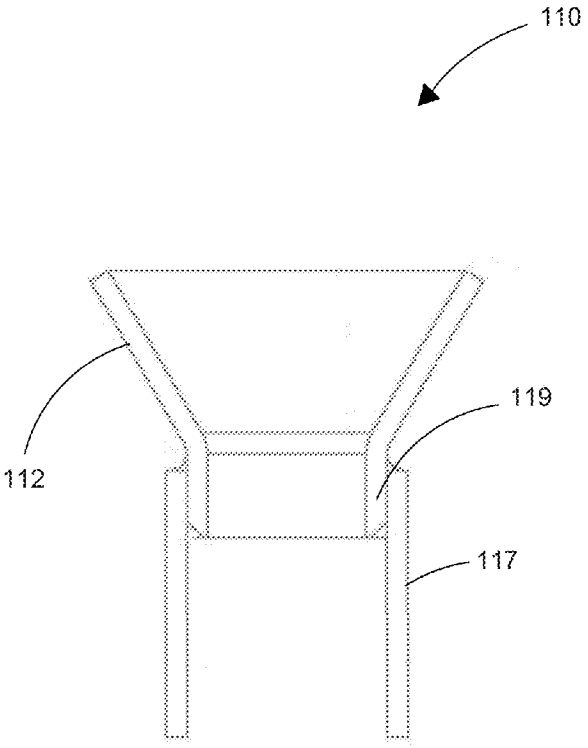
FIGS. 28A to 28C illustrate the temporary female guide of FIG. 27, used for installing the last panel for forming the tank perimeter, more particularly.
Figure 28C:
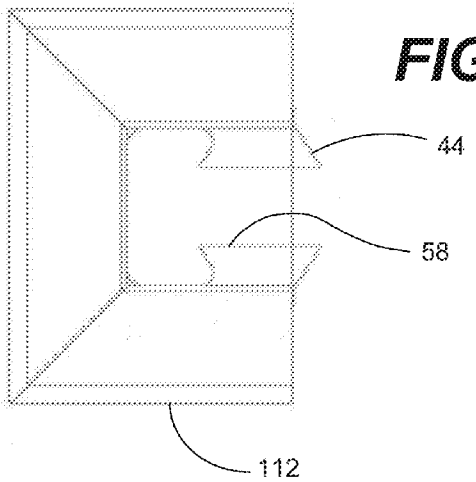
Figure 28B:
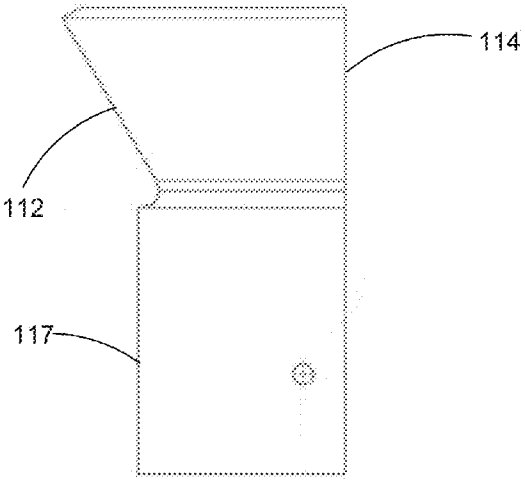

Having reference to FIG. 27, for assembly of the last panel 121, a female guide 110 as well as the male guide 100 are used to aid in alignment and connection of the tongue 50 of the male connector 46 of the last panel 121 with the groove 58 of the female connector 44 of the adjacent, already assembled panel 12.

In an embodiment, as shown in FIGS. 27 and 28A-28C, the female guide 110 is a rectangular, funnel-shaped member 112 having an open side 114 contiguous with an open edge 116 of the shaped groove 58 of the female connector 44 to permit the male connector 46 and panel end 36 of the last panel 121 to slide therethrough as the tongue 50 is axially engaged in the groove 58.

During assembly, the male guide 100 is temporarily attached to the top 92 of the tongue 50 of the already-assembled adjacent panel 12 to which the groove 58 of the female connector 44 of the last panel 121 will be attached. Further, the female guide 110 is temporarily connected to a top 118 of the groove 58 of the already-assembled adjacent panel 12 to which the tongue 50 of the male connector 46 of the last pane1121 will be attached. An extension 117, from a bottom 119 of the funnel-shaped member 112, fits over the top 118 of the groove 58 for temporarily fastening the female guide 110 thereto.

As the last panel 121 is lowered into a space 120 (FIG. 3) formed between the adjacent already-assembled panels 12, the work crew align the groove 58 of the last panel 121 with the male guide 100 and the tongue 50 of the last panel 121 with the female guide 110 and the last panel 121 is lowered therein. Thereafter, both the male and the female guides 100, 110 can be removed.

Figure 29:
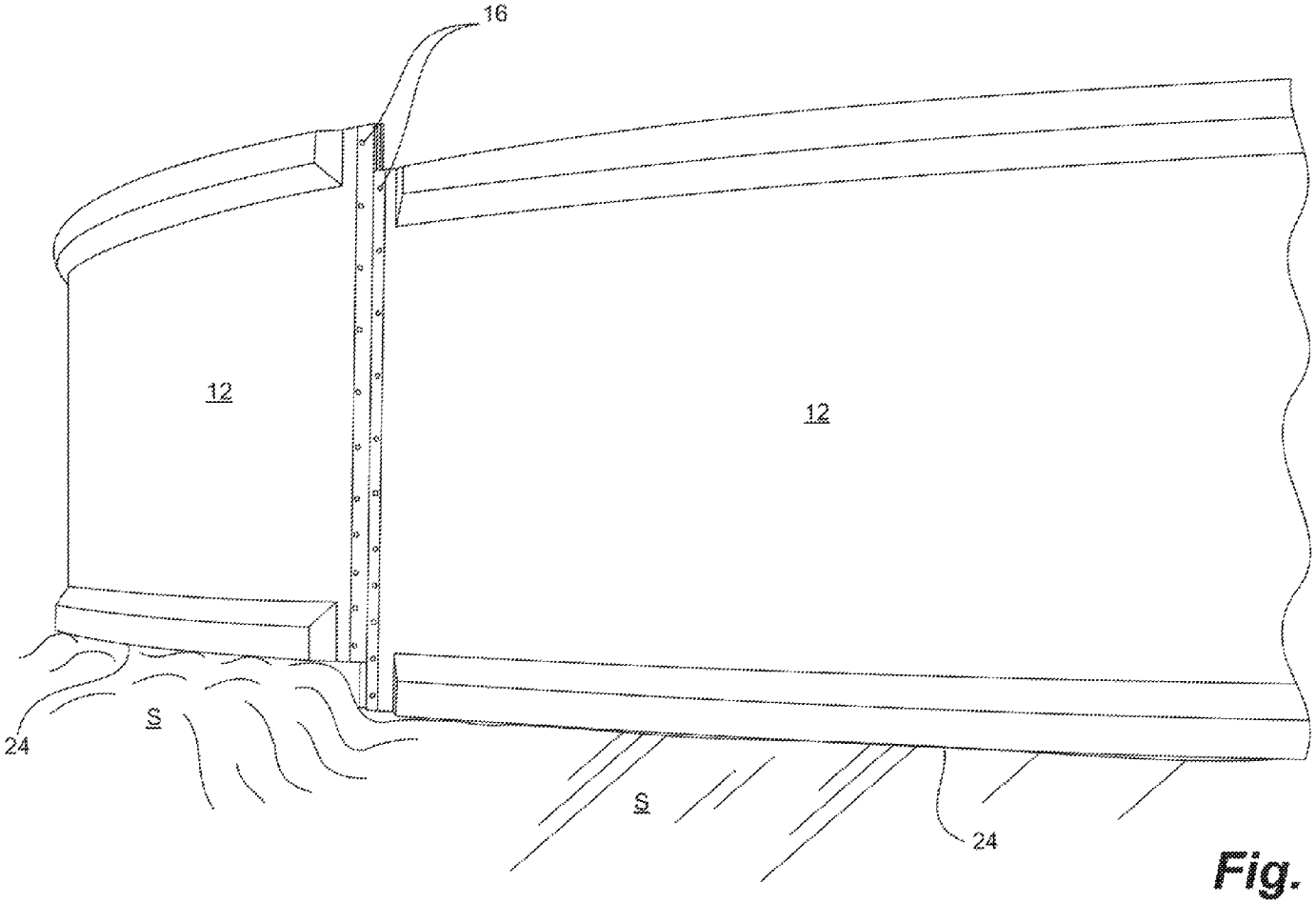
FIG. 29 is a perspective view of two assembled panels wherein the ground is sloped and there is vertical misalignment between the interconnected male and female connectors of the panels.
Figure 30:
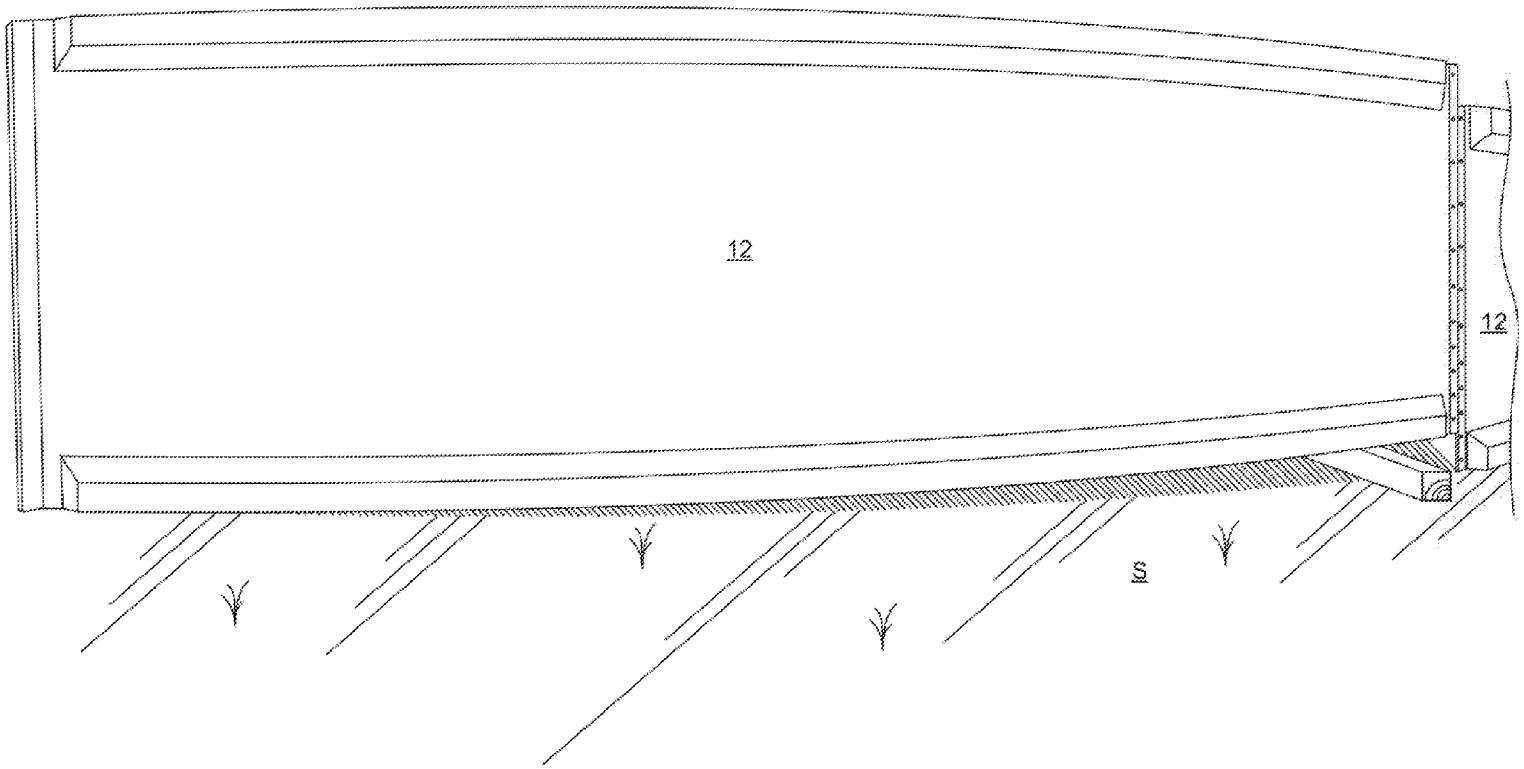
FIG. 30 is a perspective view of two assembled panels wherein the ground is clopped and there is vertical misalignment between the interconnected male and female connectors of the panels.
Figure 31:
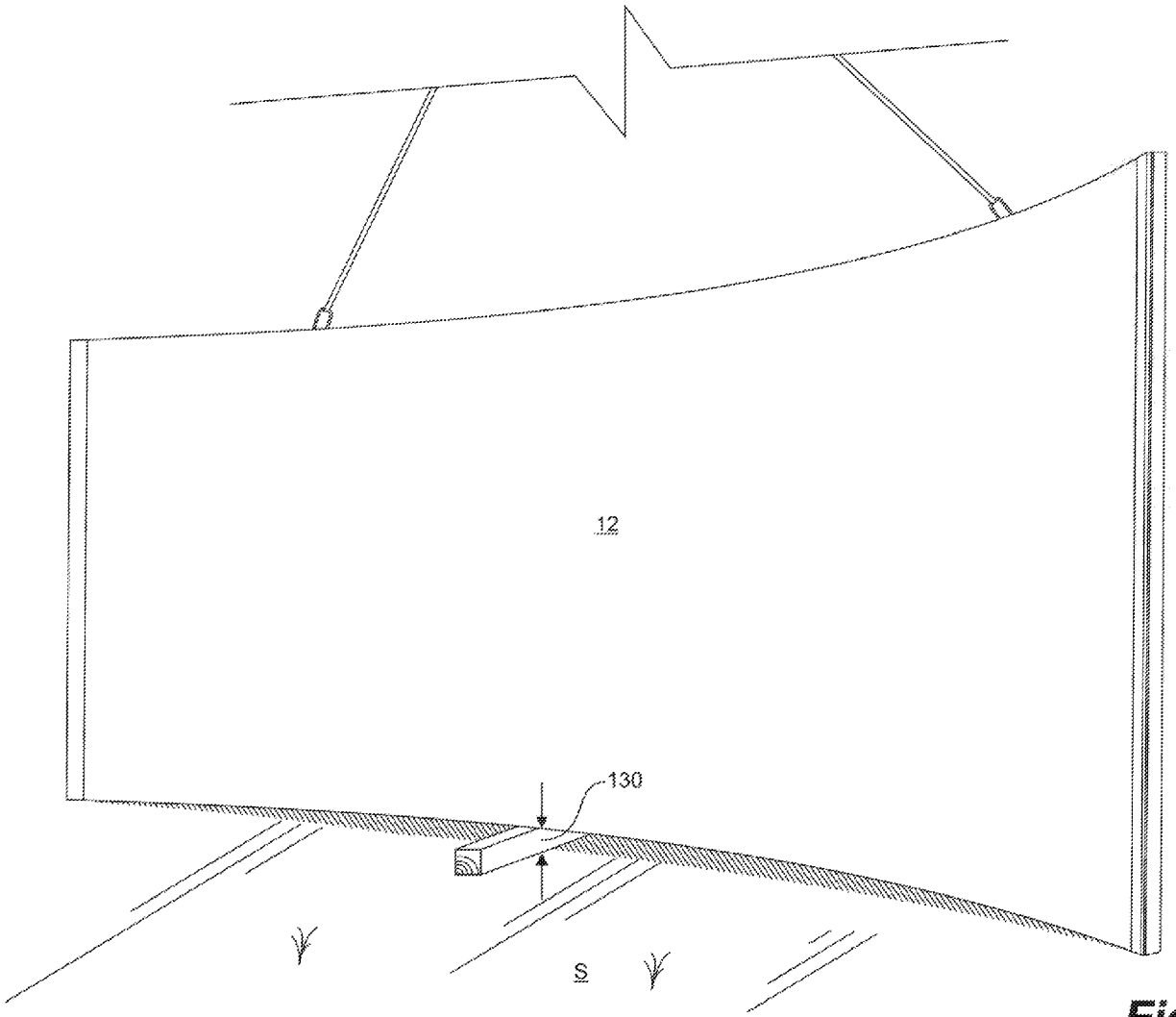
FIG. 31 is an inside perspective view of a panel aligned vertically on a ground surface that is uneven, gaps being formed between a bottom edge of the panel and the surface.

Having reference to FIGS. 29- 31, once assembled, the panels 12 are axially movable relative to each other at the interconnected female and male connectors 44,46 for vertical misalignment therebetween. Slight ground anomalies and localized shifts after installation can raise one or more panels 12 relative to the others and automatically relieve pressure at the connectors 16. Further, the system has a higher tolerance for assembly on uneven ground S than the prior art. FIGS. 29 and 30 are illustrative of a worst-case scenario typically not seen in onsite installations, however it is clear that even in such conditions, assembly is possible using the connectors 16 taught herein. In an embodiment, it is recommended that the panels 12 be misaligned vertically up to about twelve inches over the span of a single panel 12, typically about 37 feet long, while maintaining structural integrity on uneven ground.

FIG. 31 illustrates gaps 130 below the bottom edge 24 of the panel when positioned on a uneven or undulating ground surface S. In this case, the liner 70 would be required to maintain the fluid integrity of the tank 10

EXAMPLES

Table 1 is illustrative of some containment volumes and sizes of tanks assembled using panels according to embodiments disclosed herein, the panels being 10 feet in height and which have the listed length:

TABLE 1

| Diameter (ft) | π | Circumference (ft) | Number of panels | Panel length (ft) | Vol. ($ft^3$) | Vol ($m^3$) | Vol Gal | Vol BBLS | Wall Area |
|---|---|---|---|---|---|---|---|---|---|
| 173 | 3.142 | 543.5 | 14 | 38.8 | 235062 | 6656 | 1758384 | 41686 | 5435 |
| 120 | 3.142 | 377 | 10 | 37.7 | 113097 | 32.3 | 846027 | 20143 | 3770 |
| 83 | 3.142 | 260.8 | 7 | 37.25 | 54106 | 1532 | 404742 | 9637 | 2608 |

By way of example, for the 83 foot diameter, 10 foot high tank, having a 9637 barrel capacity (42 US gal/barrel), 7 panels are required for construction of the tank. Each arcuate panel is 10 feet in height and 37.25 feet in length. The composite panels each weight about 2,600 lbs per panel for a total weight of about 18,200 lbs, which is about ½ the weight of a conventional tank. The panels are of high strength and are corrosion and UV resistant. The panels have an E84 Class 1 fire rating. In a test panel, the total thickness of the panel between the stiffening ribs was about 3 inches.

High strength ¾" diameter Grade 8 hex cap screws, washers and nuts were used, such as for attachment of the connectors to the panel ends. During transport, the panels are transportable on a standard 48 foot flatbed truck and would reach the volume limit for transport before the weight limit is exceeded.

During assembly, while vertical misalignment acts to accommodate sloping ground and the like, it is not recommended that the ground be sloped more than 12" over a 37' span.

Embodiments in which an exclusive property or privilege is claimed are defined as follows:

1. A transportable tank system comprising:

three or more arcuate panels, each panel having first and second opposing and parallel ends and having a bottom edge and a top edge extending therebetween;

a male connector having a T-shaped tongue comprising a neck portion extending outwardly and generally circumferentially from the second end of the panel, and a mushroom head portion being generally perpendicular to the neck portion forming an inside dovetail groove and an outside dovetail groove;

a female connector having a generally T-shaped groove extending along the first end and shaped to receive the T-shaped tongue, the T-shaped groove comprising opposing and parallel fingers having complementary inside and outside dovetail-shaped portions adjacent the first panel end, wherein the three or more arcuate panels are arranged in a perimeter on a surface with the first and second ends oriented substantially vertically therefrom and a perimeter of the tank system is formed by circumferentially locking the panels by slidably engaging the T-shaped tongue of the male connector of one panel within the T-shaped groove of the panel adjacent thereto, engagement of the T-shaped tongue within the T-shaped groove forming a uniform gap along a perimeter of a tongue-and-groove joint formed therebetween when not in tension for allowing adjacent interconnected panels to have a hinged movement within a constrained arc radius relative to one another, and the male connector's dovetail grooves drive the female connector's dovetail-shaped portions towards each other into a gripping arrangement with the neck portion under circumferential loading; and a liner fit to the perimeter of the tank system.

2. The tank system of claim 1 wherein each arcuate panel of the three or more panels comprises:

at least an inner skin; and a core structurally bonded to the inner skin.

3. The system of claim 2 further comprises;

an outer skin for sandwiching the core between the inner skin and the outer skin.

4. The system of claim 3 wherein the inner and outer skins are formed of glass reinforced fiber polymer.

5. The system of claim 1 wherein each of the three or more arcuate panels further comprises shaped panel ends along the first and second ends, the male and female connectors being replaceably fastened to the shaped panel ends.

6. The system of claim 5 wherein the shaped panel ends comprise a structural member extending therealong and having a rectangular cross-section, and the male and female connectors further comprise a rectangular recess extending therealong and bounded by parallel flanges, the rectangular recess opposing the male and female connectors' respective tongue or groove, the rectangular recess for receiving the shaped panels end's rectangular cross-section therein.

7. The system of claim 6 wherein when the rectangular panel ends are fit within the rectangular recesses, each of the male and female connectors are secured to the panel end's structural member thereto using fasteners extending through the flanges and panel end.

8. The system of claim 1 wherein the uniform gap formed between the male connector and the female connector permits a swing movement of the three or more panels within the constrained arc radius during assembly.

9. The system of claim 1 wherein, when engaged, the tongue and the groove are slidably axially moveable relative to one another so as to permit each panel of the three or more arcuate panels to be misaligned vertically relative to adjacent panels of the three or more panels.

10. The system of claim 1 wherein each of the three or more panels further comprises:

an upper stiffening rib extending circumferentially from the first end to the second end adjacent the top edge of the panel; and a lower stiffening rib extending circumferentially from the first end to the second end adjacent the bottom edge of the panel.

11. The system of claim 10 wherein the upper and lower stiffening ribs are foam covered with glass reinforced fiber polymer.

12. The system of claim 11 wherein the foam core further comprises glass reinforced fiber polymer shear webs.

13. The system of claim 1 wherein each of the panels further comprise two or more lifting engagement means spaced along at least the top edge, equidistant from a center of gravity of the panel so that when lifted therefrom, the panel hangs vertically for parallel alignment of the elongate female connector of one panel with the elongate male connector of an adjacent panel.

14. The system of claim 1 further comprising:

a male guide temporarily attachable to an upper end of the male connector for guiding the shaped groove of a female connector to engage with the male connector on an adjacent arcuate panel.

15. The system of claim 14 when a last of the three or more arcuate panels is assembled, further comprising:

a female guide temporarily attachable to an upper end of the female connector of an adjacent panel, for guiding the shaped tongue of the male connector of last panel into the shaped groove of the female connector on the adjacent arcuate panel.

16. The system of claim 14 wherein the male guide is a right rectangular pyramidal-shaped member, an apex projecting upwardly from the panel when temporarily connected thereto.

17. The system of claim 15 wherein the female guide is a rectangular funnel-shaped member having an open side contiguous with the shaped groove for accepting the shaped tongue and male connector therein.

18. A transportable, arcuate panel for use with like panels for constructing a tank fit with a liner for containing fluid therein, the arcuate panel comprising:

first and second opposing ends and a bottom edge and a top edge extending therebetween;

at least an inner skin extending between the first and second ends;

a core structurally bonded to the inner skin;

a male connector having a T-shaped tongue comprising a neck portion extending outwardly and generally circumferentially from the second end of the panel, and a mushroom head portion being generally perpendicular to the neck portion forming an inside dovetail groove and an outside dovetail groove; and a female connector having a generally T-shaped groove extending along the first end and shaped to receive the T-shaped tongue, the T-shaped groove comprising opposing and parallel fingers having complementary inside and outside dovetail-shaped portions, wherein the head portion mates with the T-shaped groove so as to circumferentially lock the T-shaped tongue into the T-shaped groove when engaged therein and neck portion;

the T-shaped groove on the female connector and the T-shaped tongue of the male connector are adapted to engage between adjacent like panels and form a uniform gap along a perimeter of a tongue-and-groove joint formed therebetween when not in tension for allowing adjacent interconnected panels to have a hinged movement within a constrained arc radius relative to one another, and the male connector's dovetail grooves drive the female connector's dovetail-shaped portions towards each other into a gripping arrangement with the neck portion under circumferential loading.

19. The transportable arcuate panel of claim 18 further comprising an outer skin, the core being sandwiched between the inner and outer skins.

20. The transportable arcuate panel of claim 19 wherein the inner and outer skins are formed of glass reinforced fiber polymer.

21. The transportable arcuate panel of claim 18 further comprising shaped panel ends which protrude from the first and second ends generally circumferentially, the male and female connectors being replaceably fastened thereto.

22. The transportable arcuate panel of claim 21 wherein the shaped panel ends comprise a structural member extending therealong and having a rectangular cross-section and the male and female connectors further comprise a rectangular recess extending therealong and bounded by parallel flanges, opposing the tongue or groove, the rectangular recess receiving the rectangular panel ends therein.

23. The transportable arcuate panel of claim 22 wherein when the rectangular panel ends are fit within the rectangular recess, each of the male and female connectors secured to the panel end's structural member using fasteners extending through the flanges and panel end.

24. The transportable arcuate panel of claim 18 further comprising an upper stiffening rib extending circumferentially from end to end at the top of the panel and a lower stiffening rib extending circumferentially from end to end at the bottom of the panel.

25. The transportable arcuate panel of claim 18 wherein the foam core further comprises glass reinforced fiber polymer shear webs.

26. The transportable arcuate panel of claim 18 further comprising two or more lifting engagement means spaced long about the panel, equidistant from a center of gravity of the panel, so that when lifted therefrom, the panel is balanced about the center of gravity.

27. The transportable arcuate panel of claim 26 further comprising reinforcements for supporting the lifting engagement means therein under lifting loads.

28. The transportable arcuate panel of claim 27 wherein the reinforcements are stainless steel plates embedded within the arcuate panel.

29. The transportable arcuate panel of claim 18 wherein the panel is stackable with like panels on a surface for storage or transport.

* * * * *